US007198244B2

(12) United States Patent
Deline

(10) Patent No.: US 7,198,244 B2
(45) Date of Patent: Apr. 3, 2007

(54) SELF-INTERLOCKING HANGER SYSTEM

(75) Inventor: Kenneth E. Deline, Fort Collins, CO (US)

(73) Assignee: CDC Investments, LLLP, Greeley, CO (US)

( * ) Notice: Subject to any disclaimer, the term of this patent is extended or adjusted under 35 U.S.C. 154(b) by 0 days.

(21) Appl. No.: 10/637,973

(22) Filed: Aug. 8, 2003

(65) Prior Publication Data

US 2004/0108438 A1 Jun. 10, 2004

Related U.S. Application Data

(60) Provisional application No. 60/402,117, filed on Aug. 8, 2002.

(51) Int. Cl.
*A47G 1/24* (2006.01)

(52) U.S. Cl. ..... 248/495; 403/326; 24/614; 24/615

(58) Field of Classification Search ..... 248/475.1, 248/476, 477, 480, 489, 493, 222.11, 222.12, 248/225.21, 229.16, 229.26, 228.7, 230.7, 248/231.81, 222.13, 223.41, 224.51, 224.61; 24/375.1, 573.11, 578.12, 592.11, 594.11, 24/614, 615, 581.1, 586.11, 618, 625, 635
See application file for complete search history.

(56) References Cited

U.S. PATENT DOCUMENTS

| | | | | |
|---|---|---|---|---|
| 2,891,757 | A | 6/1959 | Lang | 248/224 |
| 3,809,799 | A * | 5/1974 | Taylor | 174/68.3 |
| 3,861,639 | A | 1/1975 | Morrill | 248/489 |
| 3,912,216 | A * | 10/1975 | Gano | 248/551 |
| 3,955,790 | A | 5/1976 | Ballin | 248/489 |
| 3,982,719 | A | 9/1976 | Kilborne | 248/489 |
| 4,026,510 | A | 5/1977 | Holmes | 248/493 |
| 4,069,998 | A | 1/1978 | Rytting | 248/476 |
| 4,157,624 | A | 6/1979 | Sobel | 40/152.1 |
| 4,171,117 | A | 10/1979 | Prochaska | 248/495 |
| 4,244,549 | A | 1/1981 | Oldfield | 248/494 |
| 4,333,625 | A | 6/1982 | Haug | 248/216.1 |
| 4,384,648 | A | 5/1983 | Hart et al. | 206/527 |
| 4,389,759 | A * | 6/1983 | Yuda | 24/614 |
| D275,730 | S | 10/1984 | Melley | D8/373 |
| 4,641,807 | A | 2/1987 | Phillips | 248/480 |
| 4,645,165 | A | 2/1987 | Raap | 248/476 |
| 4,775,129 | A | 10/1988 | Gleisten | 248/493 |
| 4,825,515 | A * | 5/1989 | Wolterstorff, Jr. | 24/625 |
| 4,883,247 | A | 11/1989 | Crandall | 248/542 |
| 5,048,788 | A | 9/1991 | Lorincz | 248/477 |
| D322,389 | S | 12/1991 | Harmon | D8/380 |
| 5,069,411 | A | 12/1991 | Murphy | 248/476 |
| 5,069,412 | A | 12/1991 | Jacob | 248/493 |
| 5,309,950 | A * | 5/1994 | Bassi et al. | 139/88 |
| 5,327,619 | A * | 7/1994 | Ortega | 24/625 |
| D361,260 | S | 8/1995 | Trentham | D8/373 |
| 5,440,792 | A * | 8/1995 | Ida | 24/615 |
| 5,443,238 | A | 8/1995 | Mitchell | 248/498 |
| 5,507,462 | A | 4/1996 | Hickey | 248/489 |

(Continued)

OTHER PUBLICATIONS

US PCT Patent Application, PCT/US01/09563, entitled "Compression Enhanced Self-Interlocking Hanger System", filed Mar. 23, 2001.

(Continued)

*Primary Examiner*—Kimberly Wood
(74) *Attorney, Agent, or Firm*—Craig R. Miles; CR Miles, P.C.

(57) ABSTRACT

An object hanger system which provides a pair of interlocking hanger bodies configured to provide locked securement of objects to a hanging surface.

8 Claims, 28 Drawing Sheets

U.S. PATENT DOCUMENTS

| | | | | |
|---|---|---|---|---|
| D392,176 | S | 3/1998 | Orser | D8/373 |
| 5,749,558 | A | 5/1998 | Wallo | 248/475.1 |
| 5,791,625 | A | 8/1998 | Orser | 248/495 |
| 5,816,557 | A | 10/1998 | Tepper | 248/495 |
| 5,906,349 | A | 5/1999 | Roy | 248/489 |
| 5,920,969 | A * | 7/1999 | Vuorinen | 24/614 |
| 5,947,438 | A | 9/1999 | Lemire | 248/476 |
| D421,714 | S | 3/2000 | Moscovitch et al. | D8/373 |
| 6,062,525 | A | 5/2000 | Lemire | 248/475.1 |
| 6,095,479 | A | 8/2000 | Brindisi | 248/476 |
| 6,182,946 | B1 | 2/2001 | Rutherford | 254/391 |
| D454,481 | S | 3/2002 | DeLine | D8/373 |
| D466,398 | S | 12/2002 | DeLine | D8/373 |

OTHER PUBLICATIONS

US Provisional Patent Application, 60/60/191,993, entitled "A Hanger System", filed Mar. 24, 2000.

http://www.untitedmfrs.com, United Mfrs. Supplies, Inc. Products, printed Jul. 31, 2002, pp. 1-6.

http://www.untitedmfrs.com, Image 3525 printed Jul. 31, 2002 p. 1.

http://www.untitedmfrs.com, Image 2227 printed Jul. 31, 2002 p. 1.

* cited by examiner

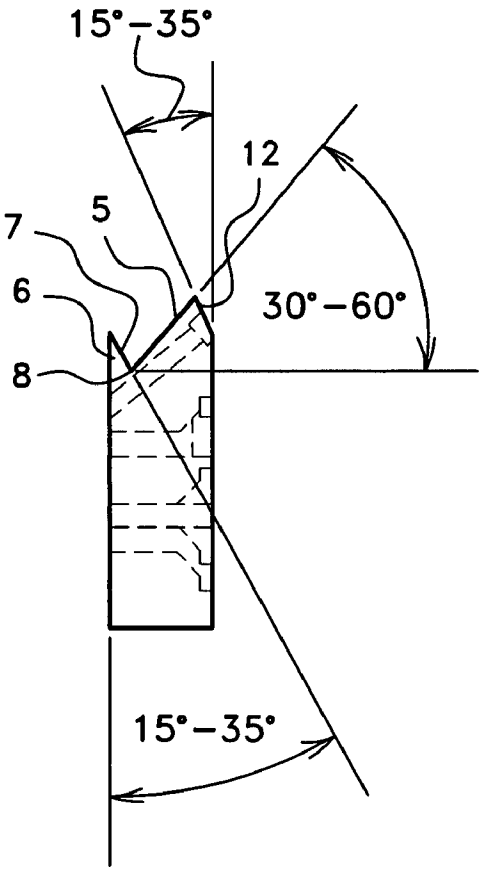
Fig. 7b
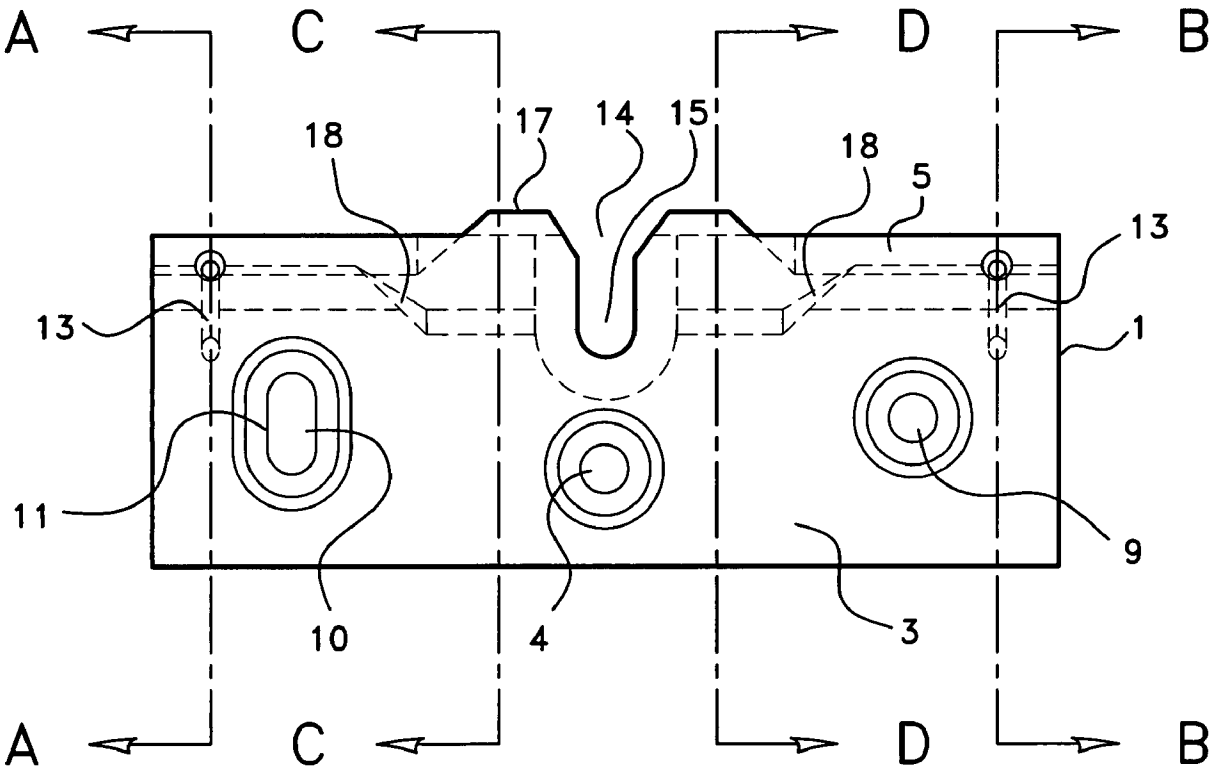
Fig. 7a
Fig. 7

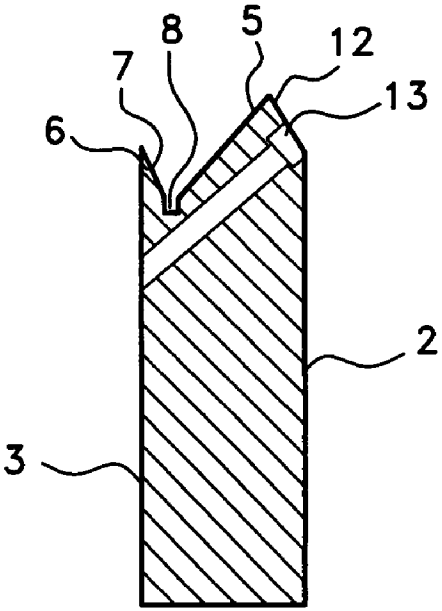
B–B
Fig. 8b
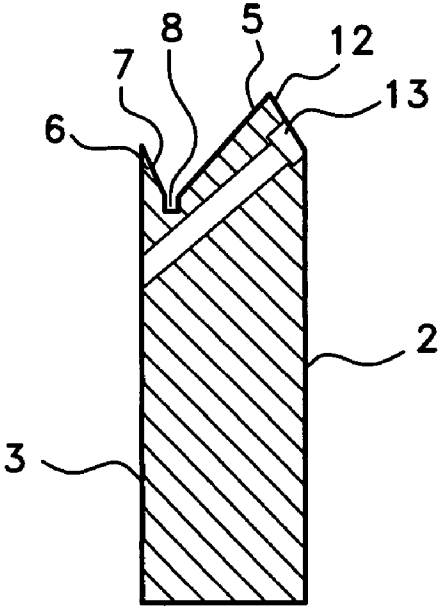
A–A
Fig. 8a
Fig. 8

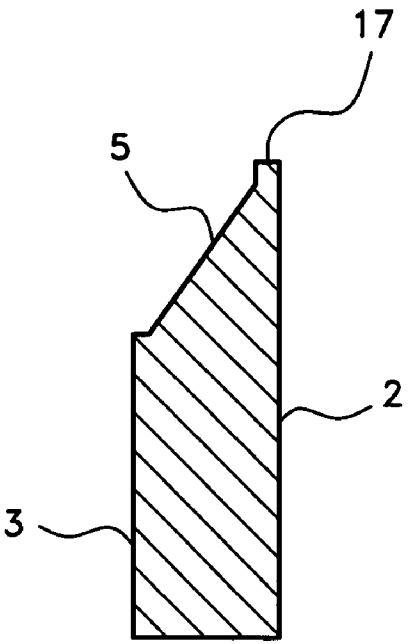
D–D
Fig. 9b
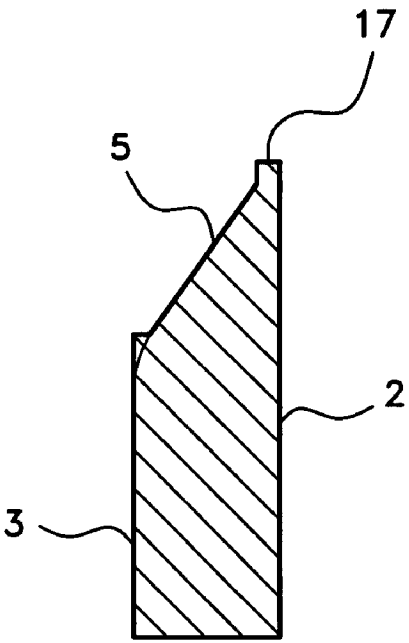
C–C
Fig. 9a
Fig. 9

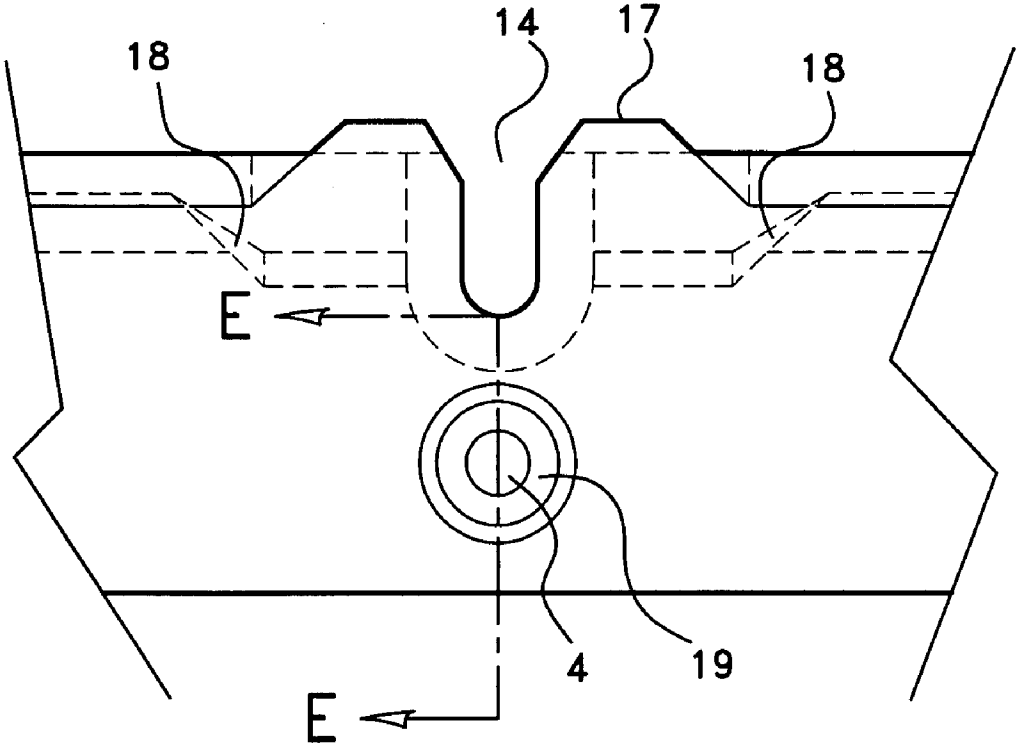
Fig. 10b
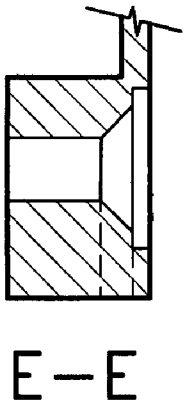
Fig. 10a
Fig. 10

F—F

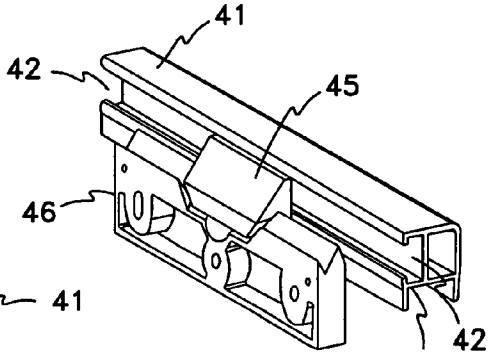
Fig. 27a
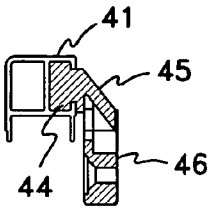
Section A–A
Fig. 27e
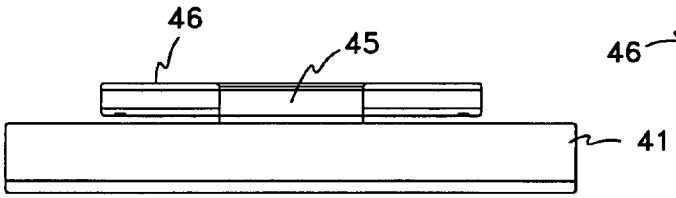
Fig. 27b
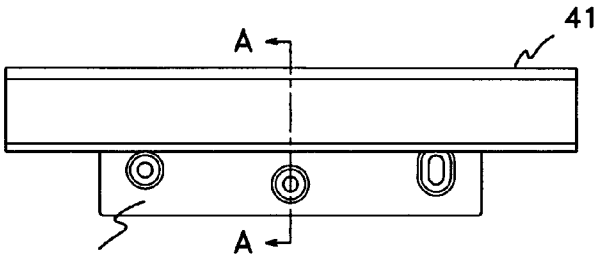
Fig. 27c
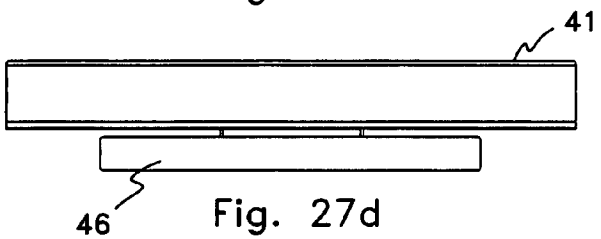
Fig. 27d
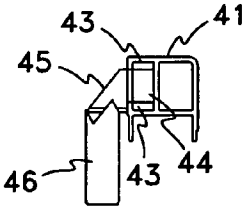
Fig. 27f
Fig. 27

SELF-INTERLOCKING HANGER SYSTEM

I. RELATED APPLICATIONS

This U.S. Pat. application claims the benefit of U.S. Provisional Patent Application No. 60/402,117, filed Aug. 8, 2002, hereby incorporated by reference.

II. BACKGROUND

Generally, an object hanger system that provides a hanger that can be used independently or can be paired in opposed mated relation to secure objects to a hanging surface. Specifically, an object hanger system which provides locked securement of objects to a hanging surface.

Hanging objects so that they are positioned correctly can be a difficult, frustrating, and time consuming task. "A little to the left. No just a bit to the right. There. No wait. Just a teensy bit to your right." And so forth, until satisfaction is achieved. Or not. "Oh just leave it!"

For centuries people have been hanging a wide variety of objects such as fine art, mirrors, furniture, knick knacks, framed items, or the like to surfaces. At one time or another nearly every person will use a hanger to secure an object to a surface. Because there is a large commercial market for hanger devices, the manner of securing objects to surfaces has taken a variety of forms. In spite of the variety of hanger devices available to the consumer, substantial problems remain unresolved with respect to providing an object hanger that maintains objects in the desired orientation with respect to the hanging surface, and with respect to providing an object hanger that has a multiplex of hanger technologies in a single hanger device. As such, there remains a long felt, but unresolved need, for an object hanger that can be used to hang a variety of objects and which maintains the objects in a desired orientation with respect to the hanging surface.

A significant problem with conventional hanger devices may be that the suspension element is responsive to a single point hanger. Single point hangers encompass any object hanger which provides a single suspension point, or single support point, to which a portion of a suspension element is responsive. For example, a nail driven into the hanging surface provides a single point hanger. Other examples of single point hangers are disclosed by U.S. Pat. Nos. 5,507,462; 3,861,639; 4,641,807; 5,048,788; 5,906,349; and 4,026,510, hereby incorporated by reference. As can be understood, when the ends of a suspension element, such as a wire or a cord, are connected a distance apart to the object to be hung and when a portion of the suspension element is made responsive to a single point hanger, the suspension element forms a triangle. The base of the triangle can be defined by the distance between the two ends connected to the object and the two sides having an apex at the single point hanger. There may be no manner of adjusting the orientation of the object relative to the hanging surface but to change the length of the two sides of the triangle by moving the portion of the suspension element responsive to the single point hanger. If the object must be level with the horizon or parallel with an architectural line of a room (such as, the ceiling or floor) or other feature to which the objects orientation is made relative, it can be extremely difficult to find and position the exact portion of the suspension element that must be responsive to the single point hanger to orient the object properly.

Another significant problem with conventional hanger devices may be that they do not provide lateral or vertical adjustment of the object after it is hung. As discussed above, in most cases, the single point hanger only allows the orientation of the object relative to the hanging surface to be changed by adjusting the length of the suspension element defining the two sides of the triangle on either side of the apex defined by the single point hanger. The single point hanger typically does not allow for any other type of adjustment, such as lateral or vertical adjustment of the object. In some cases, where an attempt is made to provide additional adjustment, such as the hanger device disclosed by U.S. Pat. No. 4,645,165, hereby incorporated by reference, the problems associated with the use of a single point hanger are not also addressed. Other configurations of hanger devices, such as the hanger device disclosed by U.S. Pat. No. 4,171,117, hereby incorporated by reference, which may stabilize the orientation of objects relative to the hanging surface by providing rotatably adjustable interlocking pieces do not provide a manner of further adjustment of the object laterally or vertically.

Another significant problem with conventional hanger devices may be that the hanger devices do not provide sufficient compression of the suspension element or interlocking components to provide sufficient resistance to movement of the hung object. With respect to conventional single point hangers, insufficient friction may be placed on the suspension element to maintain the object in the desired orientation once hung. In some cases, even small differences in the weight of the object itself on either side of the single point hanger may be sufficient to allow the suspension element to move allowing the object to move from the desired orientation. With respect to other types of hangers, the weight of the object may be insufficient to develop sufficient frictional forces between conventional hanger components to maintain their relative positions.

Another significant problem with conventional hanger devices may be that they are comprised of multiple components designed to mate together have different configurations. Examples are disclosed by U.S. Pat. Nos. 361,260; 4,883,247; 5,443238; 4,069,998; 3,955,790; 4,645,165, and 4,171,117, hereby incorporated by reference. Thus, with respect to manufacturing these conventional hanger devices, separate tooling may be required to make each of the unique components. Moreover, these types of hanger devices may only function when mating these unique components together. Additionally, these types of hanger devices may have only limited application. For example, U.S. Pat. No. 5,443,238, hereby incorporated by reference, discloses a hanger device that mates only with a particular type of slotted frame backer material on an object.

Another significant problem with conventional hanger devices may be that they cannot be used for a multiple applications. As disclosed by U.S. Pat. Nos. 3,982,719; 4,244,549; 5,069,412; 4,333,625; and 275,730, hereby incorporated by reference, these conventional hanger devices can only be used when the suspension element is wire or cord-like. U.S. Pat. No. 4,384,648, hereby incorporated by reference, discloses a locator device for hanger devices that comprise a wire or cord-like suspension element and eyelets. U.S. Pat. No. 5,791,625, hereby incorporated by reference, may only be used with a saw-tooth hanging bracket.

Another problem with conventional hanger devices may be that they have too many components or may be difficult to use. For example, U.S. Pat. Nos. 4,244,549; and 5,947,438, hereby incorporated by reference, discloses the use of a wire that must make a circuitous route through the hanger device to function properly. Alternately, as shown by U.S.

Pat. No. 5,069,411, hereby incorporated by reference, the hanger device has numerous components to assemble prior to use.

Another problem with conventional hanger devices may be that they do not provide locked securement of objects to a hanging surface, or lock elements are physically discrete from the hanger elements, or locked securement occurs in a discrete step from engaging the hanger elements in opposed mated relation, or do not provide locked securement as a result of opposed mated relation of the hanger elements, or the lock elements and the hanger elements are not a single continuously integral component.

Yet another problem with conventional hanger devices may be that they are not compatible with or attach readily to metal or plastic extrusions used to frame objects, such as pictures.

With respect to making and using object hangers, the present invention discloses technology which addresses every one of the above-mentioned problems.

III. SUMMARY OF THE INVENTION

A broad object of the invention is to provide an object hanger system having features which assist in hanging objects on hanging surfaces in the desired orientation. The embodiments of the object hanger invention and the methods of hanging objects disclosed are varied and may be incorporated into a variety of hanger technologies used in numerous hanging applications. Naturally, as a result of these several different and potentially independent aspects of the invention, the specific objects of the invention are quite varied.

Moreover, as can be understood from the description, the hanger invention includes a variety of aspects which may result in various combinations and permutations of the invention. As such, embodiments of the invention should be understood to involve each aspect independently, in various combinations or permutations, or collectively to create a multi-purpose hanger system.

A significant object of embodiments of the invention can be to provide a dual point hanger system. The dual point hanger system addresses the problems with respect to single point hangers as discussed above. The dual point hanger system can eliminate or minimize the effort required to make fine adjustments to the suspension elements (wires, cords, sawtooth elements, or the like) responsive to a single point hanger and can provide frictional surfaces or compression surfaces to resist displacement of the hung object from the desired orientation.

Another significant object of embodiments of the invention can be to provide an interlocking embodiment of the hanger invention. The interlocking embodiment of the invention can be used in various manners to provide three point, four point, or modified sawtooth hanging systems, among others.

Another significant object of embodiments of the invention can be to provide a three point hanger system. The three point hanging system provides a manner of hanging an object without the use of a wire, cord, or saw-tooth suspension element, or the like. The three point hanging system can also provide additional rotational and lateral adjustment of the object relative to the hanging surface.

Another significant object of embodiments of the invention can be to provide a four point hanger system. The four point hanger system provides enhanced stability with respect to hanging larger objects or asymmetrical objects which require fine rotational and lateral adjustments with respect to the hanging surface.

Another object of embodiments of the invention can be to provide interlocking elements. In these embodiments of the invention, the hanger can be used with itself in the three point or four point hanger systems described above. The interlocking embodiments of the invention provide a stable manner to hang an object. Another benefit of using the interlocking embodiments of the invention can be that the hung objects will stay close to the hanging surface. When wire or cord-like suspension elements are used the objects tend to lean away from the wall.

Another significant object of embodiments of the invention can be to provide compression elements. One aspect of providing compression elements can be to increase friction between a suspension element, such as a wire or cord, and the hanger. A second aspect of providing compression elements can be to increase the frictional surface area between hangers used in the interlocking embodiment of the invention. A third aspect of providing compression elements can be to increase the friction between two surfaces. As to each of these, the compression aspects of the invention to resist the movement of the object hung.

Another object of the invention can be to provide a multi-purpose hanger system. In a single configuration, the instant hanger invention can provide features compatible with numerous types of conventional hanger devices and hanger hardware such as wire, nails, screws, or saw-tooth hangers, to name a few; or can be compatible with itself in the interlocking embodiment of the invention.

Another significant object of the invention can be to provide locked securement of objects to the hanging surface. One aspect of this object of the invention can be to provide lock elements that are integral to the hanger. A second aspect of this object of the invention can be to provide locked securement of the object to the hanging surface in a single step in combination with opposably mating the hanger elements. By providing the lock elements integral to the hanger elements, embodiments of the invention can comprise a hanger having a first piece and a second piece that opposably mate to provide both securement of the object to the hanging surface and locked securement of the hanger, and can further comprise a hanger element and lock element manufactured from a single continuous piece of material.

Another significant object of the invention can be to utilize the resiliently flexible walls of extrusions (metal, plastic, wood, or otherwise) used to frame objects to generate sufficient compression forces to act in opposition to radially resilient rotational lock of a hanger.

Naturally, further independent objects of the invention are disclosed throughout other areas of the specification and drawings.

IV. BRIEF DESCRIPTION OF THE DRAWINGS

FIG. 7 shows a back view and an end view of a particular embodiment of the invention.

FIG. 8 shows two cross sections through a particular embodiment of a mechanical fastener interpenetration element coordinated with an inclined strike surface.

FIG. 9 shows two cross sections through a particular embodiment of a lateral adjustment projection.

FIG. 10 shows a cross section of a particular embodiment of a mechanical fastener interpenetration element having a mechanical fastener recess element.

FIG. 27 shows views of a hanger having a radially resilient rotational lock.

V. DETAILED DESCRIPTION OF THE PREFERRED EMBODIMENTS

The invention constitutes a hanger system and the methods which disclose how to make and how to use compression enhanced self-interlocking hanger system technology. The hanger invention satisfies a long felt need for a hanger system which assists in orienting objects relative to a hanging surface, and further helps to maintain the desired orientation of objects.

The invention can be accomplished as disclosed herein and with respect to some embodiments of the invention in conjunction with the various hanger devices disclosed by: U.S. Design Pat. No. D454481; U.S. Design patent application Ser. No. 29,157,431; and International Patent Cooperation Treaty Application No. PCT/US01/09563, each hereby incorporated by reference herein along with any Figures, exhibits, or attachments to those applications.

Figure 1:
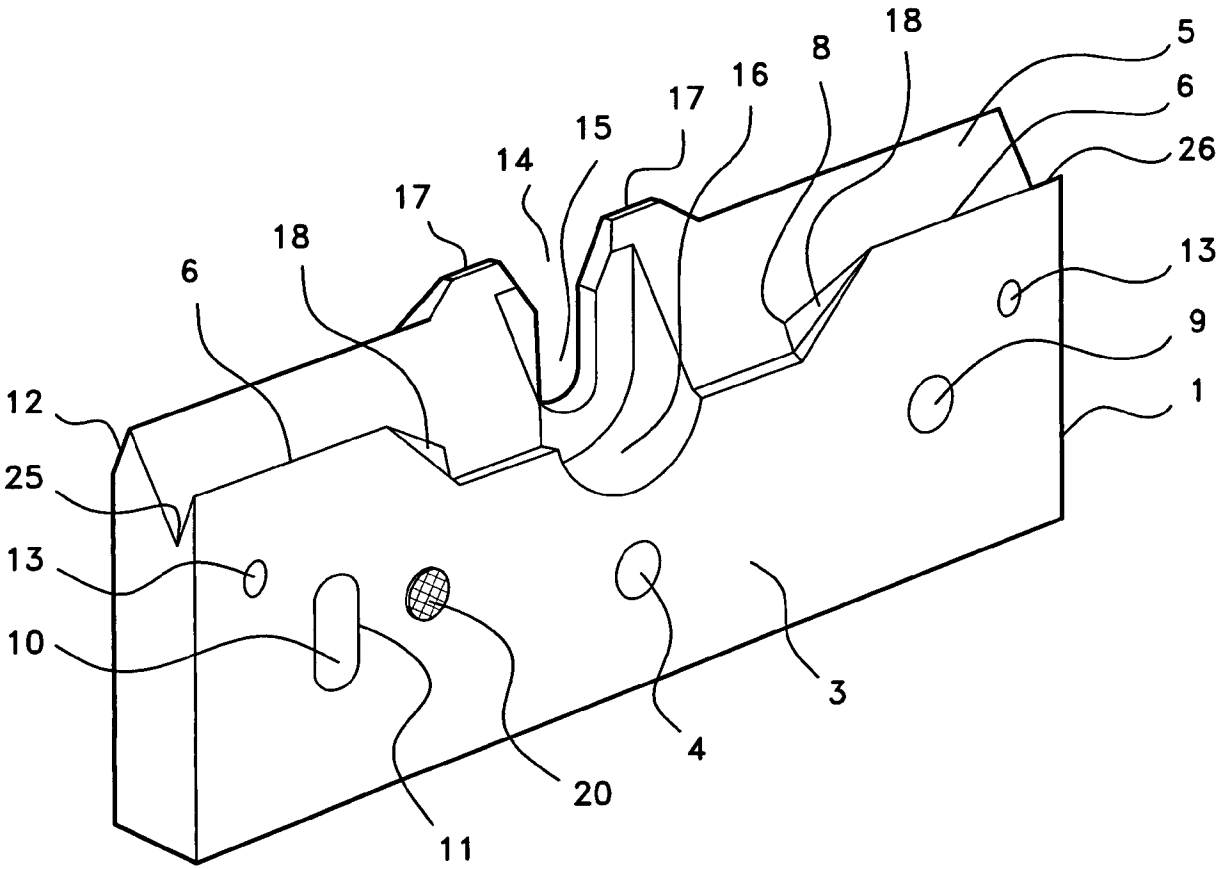
FIG. 1 shows a perspective view of the backside of a particular embodiment of the hanger invention.
Figure 2:
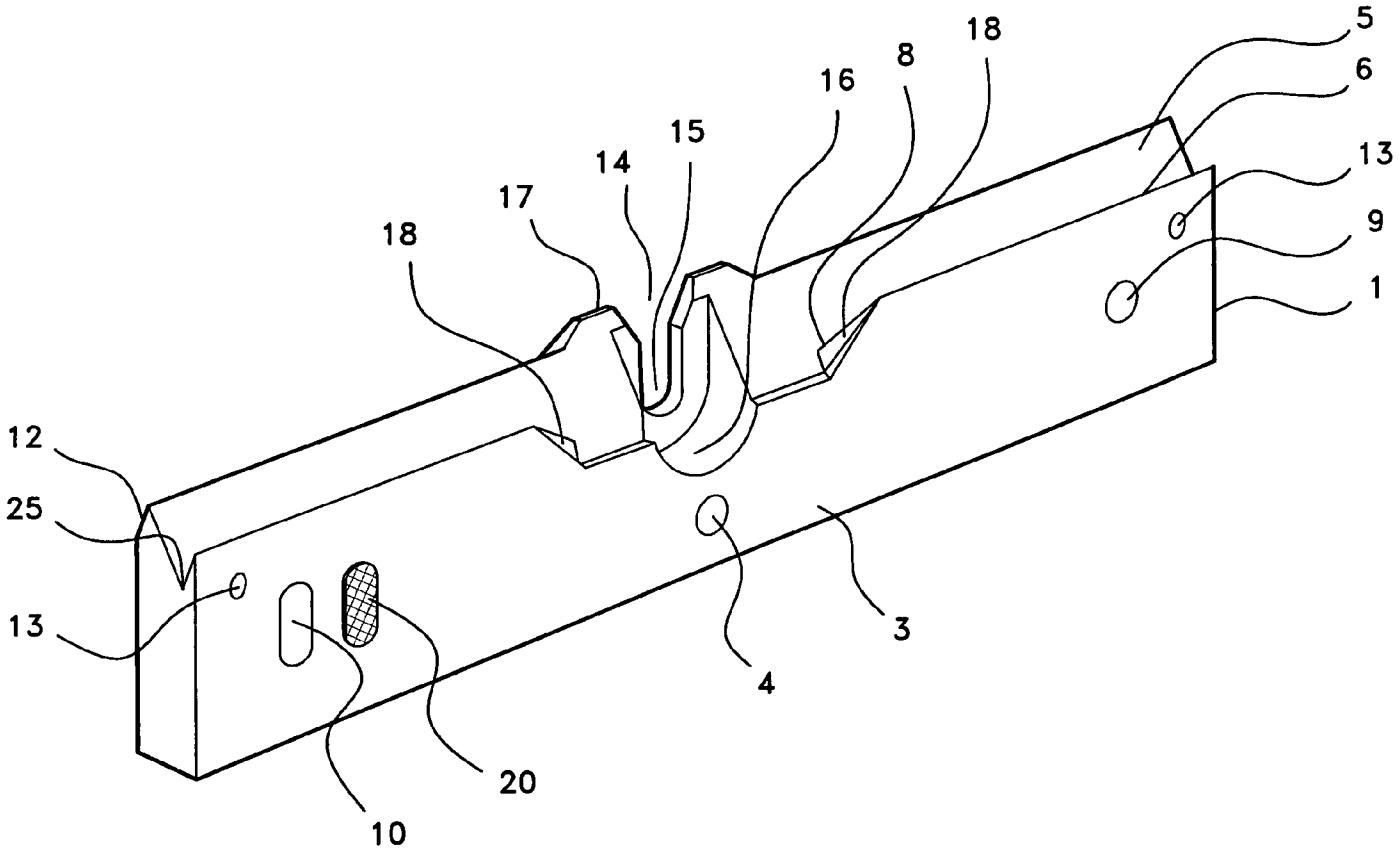
FIG. 2 shows a perspective view of the backside of a particular embodiment of the hanger invention.

Referring first to FIGS. 1 through 4, a basic embodiment of the hanger invention can comprise a hanger body (1). As illustrated in FIGS. 1 and 2, the hanger body (1) can be rectangular in configuration having a variable height, width, or depth depending on the application. However, the figures should not to be construed as limiting the configuration of the hanger body (1) the illustrated configurations and other polygonal or non-polygonal configurations could be employed using various elements and aspects of the invention described below. The hanger body (1) can be made from any material which may be molded or otherwise configured to provide the various elements disclosed. Materials, including, but not limited to, wood, metal, or plastic can be used. The front surface (2) and the back surface (3) of the hanger body (1) can communicate through at least one mechanical fastener interpenetration element (4). The size and shape of mechanical fastener interpenetration element can vary to accommodate numerous types of mechanical fasteners, such as nails, screws, bolts, molly fasteners, expansion fasteners, or the like.

The hanger invention may also comprise a hanger body edge having a beveled surface (5). The dimensions of the beveled surface, the inclination of the bevel surface, and the surface area of the beveled surface may be adjusted from application to application. The inclination of the beveled surface (5) can typically range between about 30 degrees to about 60 degrees from perpendicular with the back surface, as shown in FIG. 7. Certain applications may require greater or less inclination.

The hanger invention can also include a compression element (6) coupled to the beveled surface. The compression element (6) may be a continuous compression element positioned along the entire length of the beveled surface (5), or the compression element may comprise a pair of compression elements (6) as shown in FIGS. 1–6. Where the compression element is configured as a pair of compression elements the actual width of each compression element of the pair may vary in length. In some embodiments of the invention, each of the pair of compression elements (6) may be distal from each other having a location at or near the ends of the hanger body (1). The compression element can further comprise an inclined surface (7) as shown on FIGS. 3, 6, or 7. The angle of the inclined surface (7) may vary from application to application. Typically, the angle of the inclined surface (7) can be between 15 degrees to about 30 degrees, as shown by FIG. 7. The intersection of the planes of the beveled surface (5) and the inclined surface (7) can provide a compression groove (8). The compression groove can compress a wire-like or cord-like suspension element (21), such as the type illustrated in FIG. 14.

A second mechanical fastener interpenetration element (9) that communicates between the front surface (2) and the back surface (3) can define a rotation axis of a mechanical fastener. A third mechanical fastener interpenetration element (10) can have a location a distance from the second mechanical fastener interpenetration element (9). The invention can further comprise a rotation adjustment element (11) coupled to the third mechanical fastener interpenetration element. The rotation adjustment element (11) can allow the third mechanical interpenetration element (10) to rotate with respect to the rotation axis defined by the second mechanical fastener interpenetration element (9). Each of the various mechanical fastener interpenetration elements can further comprise a mechanical fastener recess elements (19).

Figure 3:
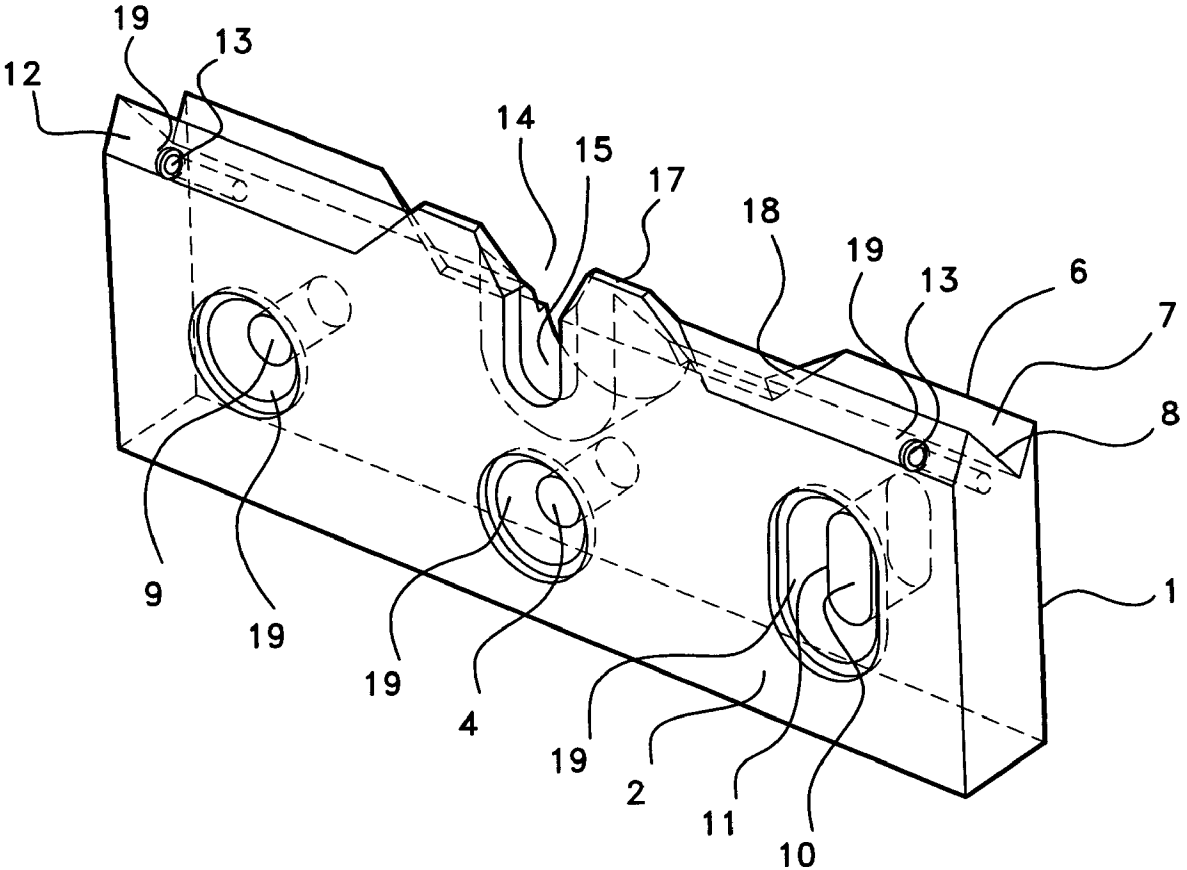
FIG. 3 shows a perspective view of the front side of a particular embodiment of the invention.
Figure 4:
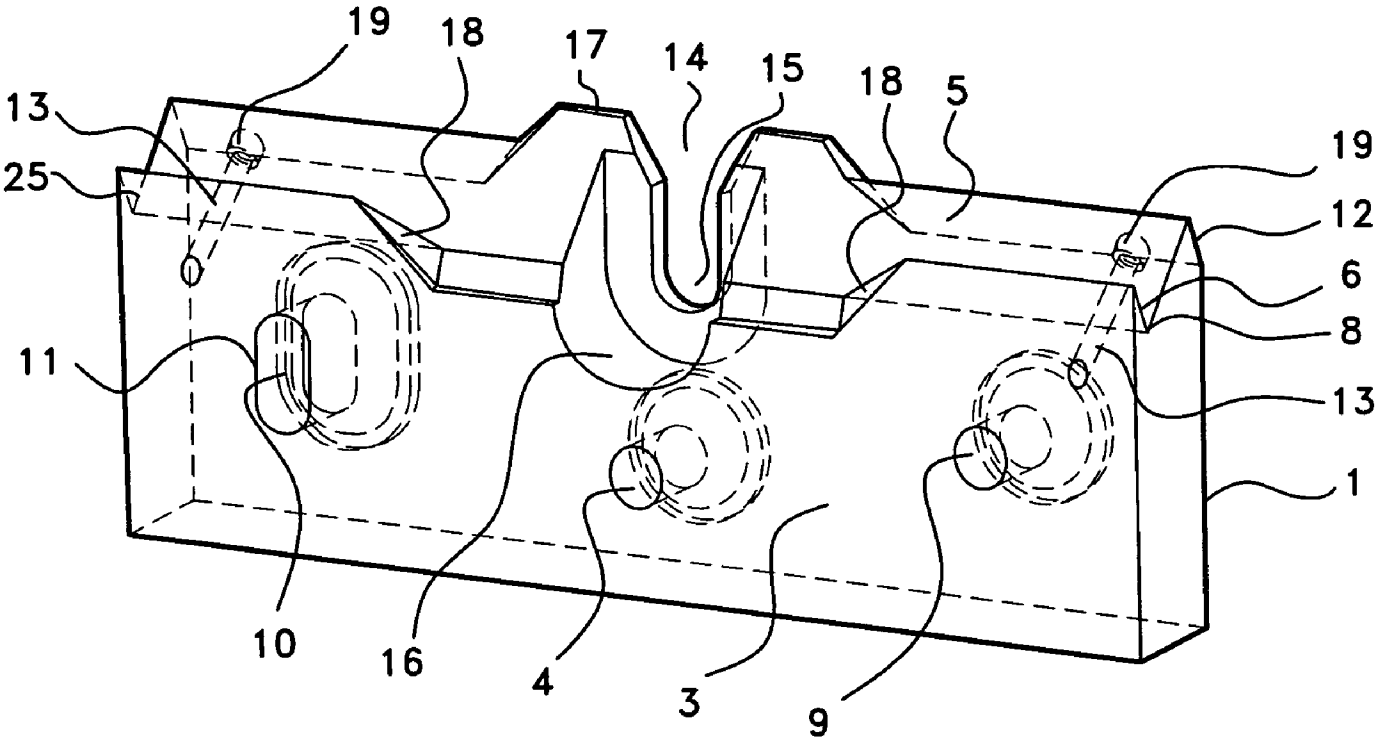
FIG. 4 shows a perspective view of the backside of a particular embodiment of the invention.
Figure 5:
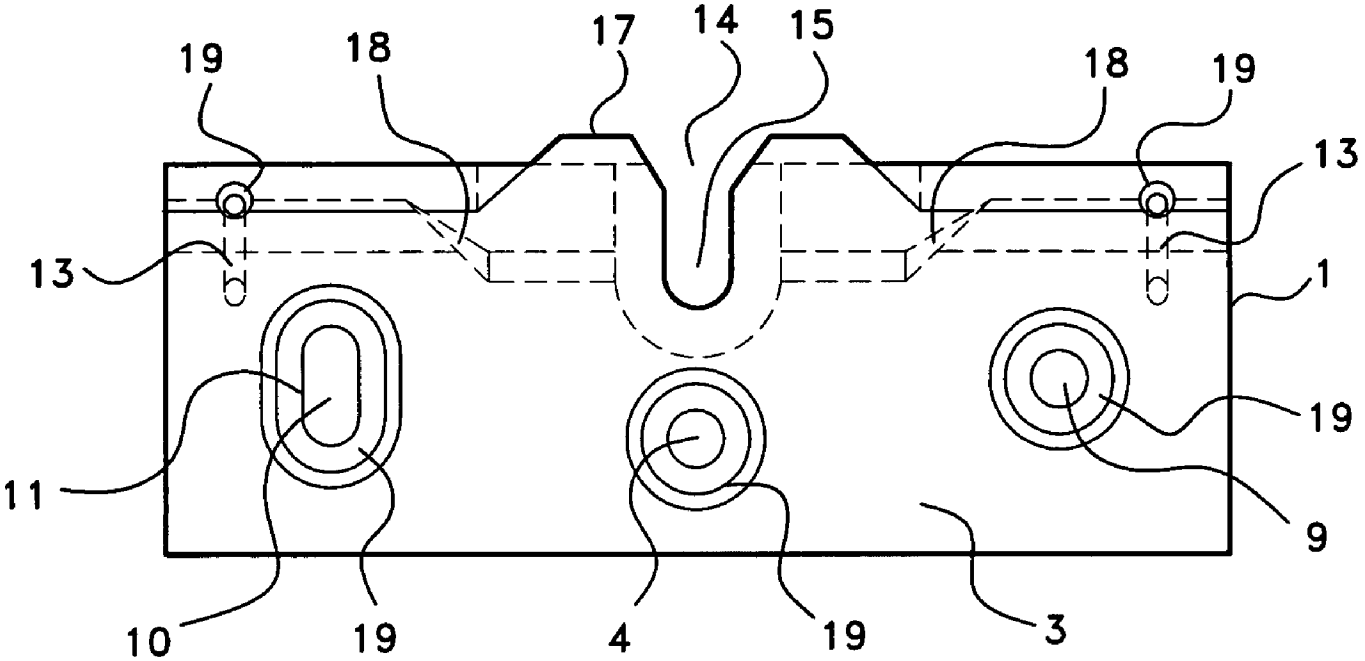
FIG. 5 shows a back view of a particular embodiment of the invention.
Figures 6, 6A, 6B:
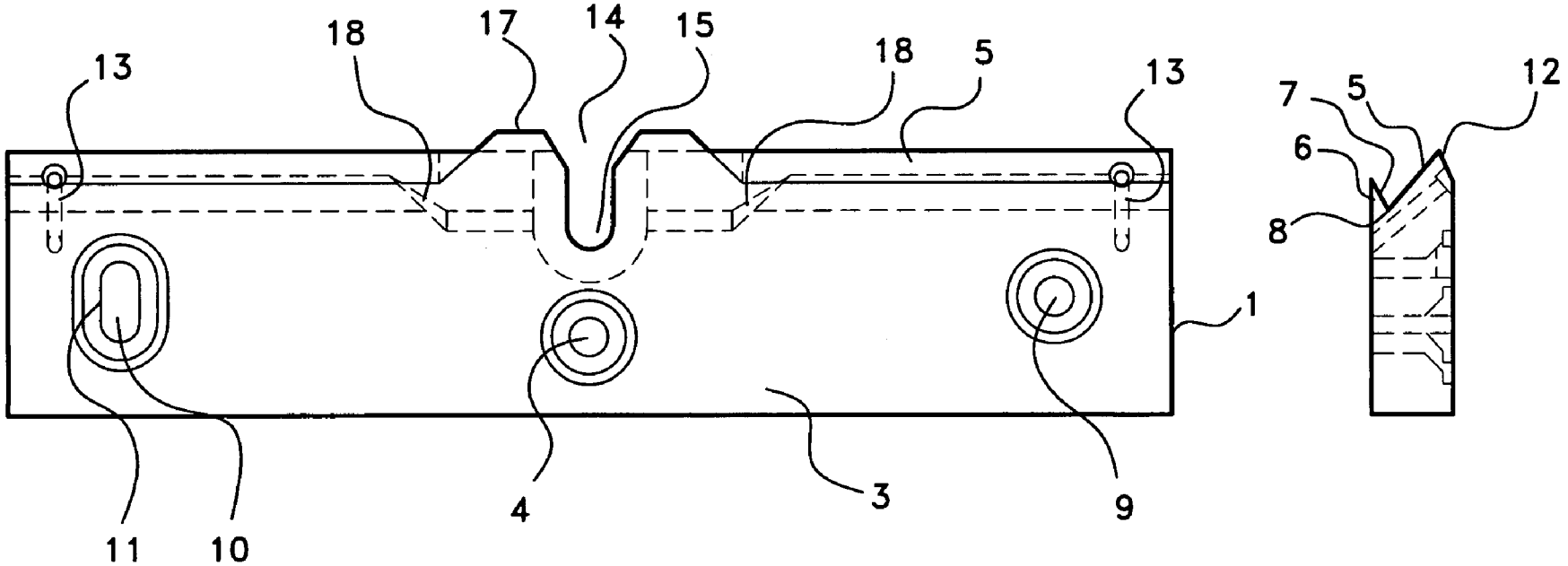
FIG. 6 shows a back view and an end view of a particular embodiment of the invention.

Certain embodiments of the invention may also include an inclined strike surface (12) as shown by FIGS. 3, 6, and 7. The inclined strike surface (12) intersects the planes of both the front surface (2) of the hanger body (1) and the beveled surface (5) of the hanger body edge. The inclined strike surface (12) can vary in size, inclination, or surface area depending on the application. The inclination of the inclined strike surface (12) can vary with respect the hanger body front surface (2) but can typically be between about 15 degrees to about 35 degrees, as shown in FIG. 7. Certain applications may require an inclination outside this range. The inclined strike surface (12) can further comprise at least one strike surface mechanical fastener interpenetration element (13). While the strike surface mechanical fastener interpenetration elements shown by the figures are configured for a finish nail, the strike surface mechanical fastener interpenetration element (13) could be configured for a variety of mechanical fasteners. The inclined strike surface (12) provides access for the tool used to set the mechanical fasteners responsive to the strike surface mechanical fastener interpenetration elements (13). For example, if a nail is used, the inclined strike surface allows the head of the nail to be driven into the recess element (19).

Some embodiments of the hanger invention may further comprise a mechanical fastener securement device (14). The mechanical fastener securement device can comprise an interpenetration between the front surface (2) and the back surface (3) of the hanger body (1) at a location where the interpenetration has a open perimeter at a point along the beveled surface (5). As shown in FIGS. 1–7, the open perimeter interpenetration can comprise a vertical slot (15). The dimensions of, or shape of, the open perimeter interpenetration could vary depending on the application. The mechanical fastener securement device (14) could further comprise a recess (16) defined by the back surface (3) of the hanger body (1). The recess (16) can be substantially aligned with the axis of the interpenetration of the mechanical fastener-securement device.

The hanger invention can also comprise a lateral adjustment projection (17) coupled to the beveled surface (5) of the hanger body (1). The lateral adjustment projection (17) can be a single projection, or as shown in FIGS. 1–7, can be bifurcated by the open perimeter interpenetration or slot (15) of the mechanical fastener securement device (14). In some embodiments of the invention, a pair of lateral adjustment stops (18) can be coupled to the beveled surface (5) or can be configured as part of the compression element (6). In the interlocking embodiment of the invention the lateral adjustment projection (17) can travel between the two lateral adjustment stops (18).

Some embodiments of the invention can further include a friction augmentation element (20) located on the back side (3) of the hanger body, as shown in FIGS. 1 and 2. The friction augmentation element (20) can be a made from different type of material than the hanger body (1) or can be the same material as the hanger body (1). The friction augmentation element (20) can be a separately applied material or can be a integral component of a unitized hanger. The surface of the friction augmentation element (20) can be textured or smooth so long as it provides the desired amount of enhanced friction between the back surface (3) of the hanger body (1) and the hanging surface.

Figure 11:
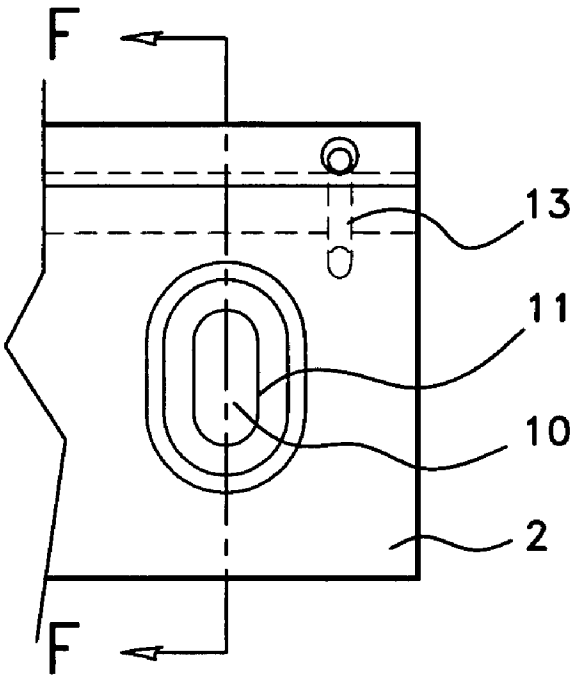
FIG. 11 shows a cross section of a particular embodiment of a mechanical fastener interpenetration element having an adjustable rotation element.
Figure 11:
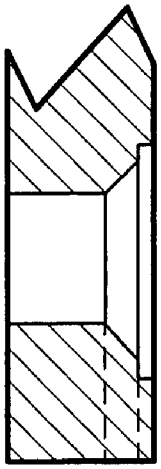

Now referring to FIGS. 8–11, cross section views further disclose various elements of compression enhanced self-interlocking hanger technology. FIG. 8 details an embodiment of the inclined strike surface (12) and strike surface mechanical fastener interpenetration element (13). FIG. 9 details an embodiment of the lateral adjustment projection element (17). FIG. 10 details an embodiment of the mechanical fastener interpenetration element (4). FIG. 11 details an embodiment of the third mechanical fastener interpenetration (10) element further comprising the rotation adjustment element (11).

Figure 12:
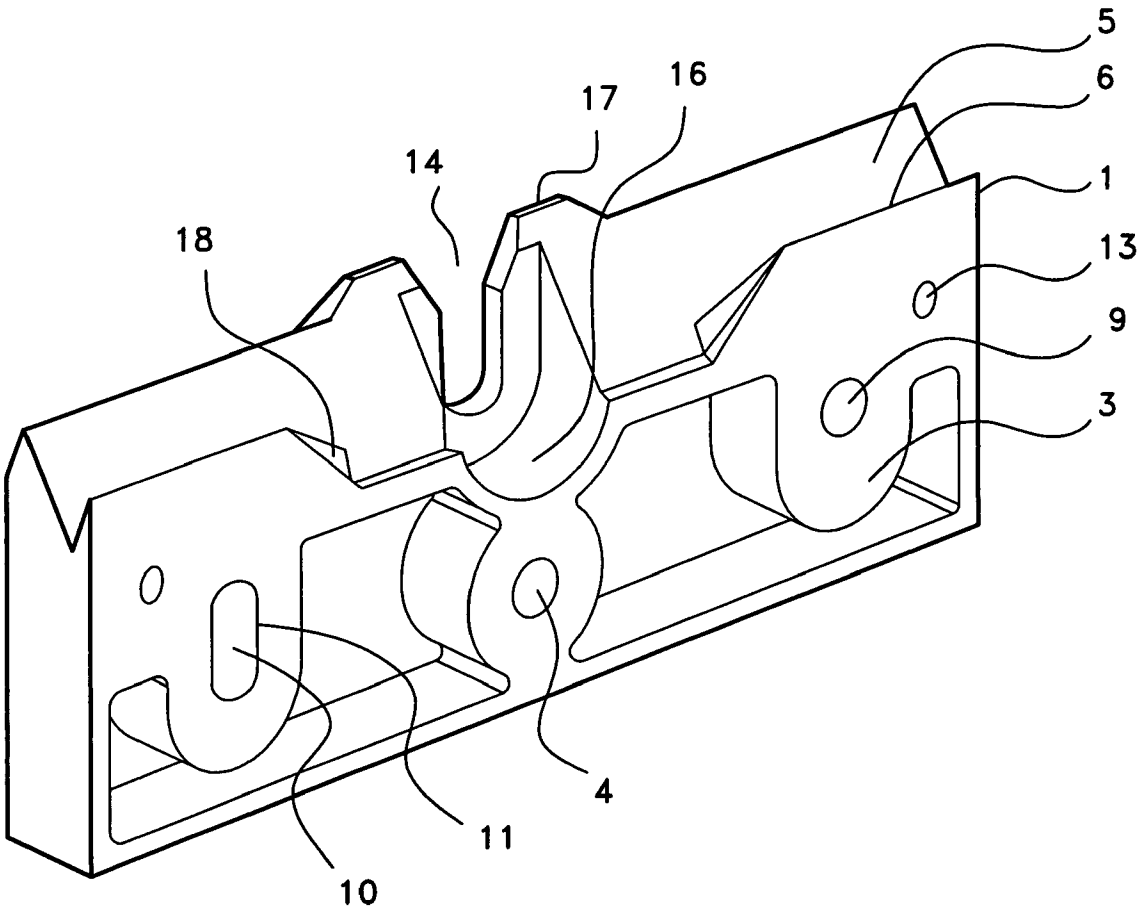
FIG. 12 shows a perspective view of the back side of a particular embodiment of the invention having a particular injection molding configuration.
Figure 13:
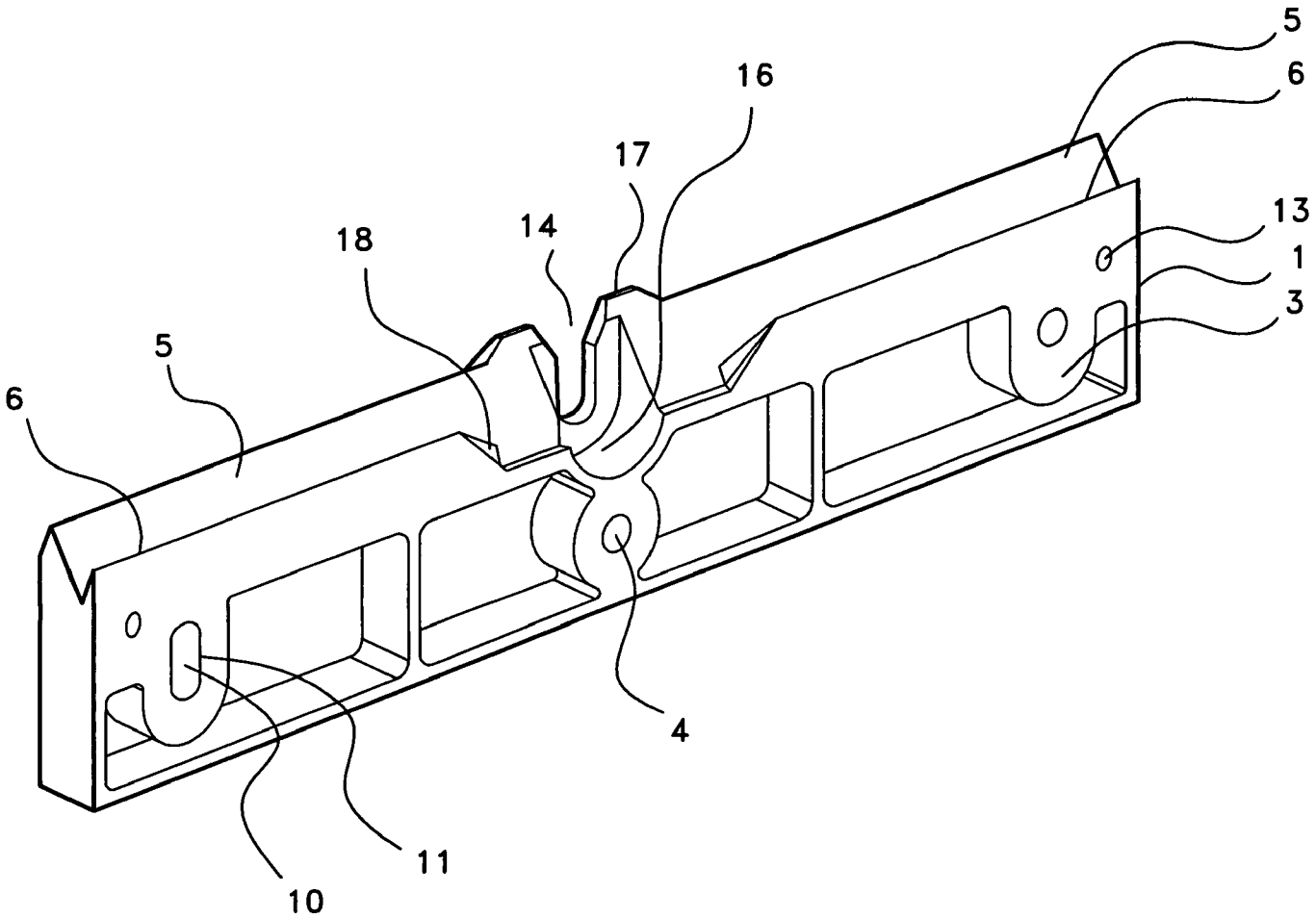
FIG. 13 shows a perspective view of the back side of a particular embodiment of the invention having a particular injection molding configuration.

Now referring to FIGS. 12 and 13, configurations for injection molding the hanger body (1) are illustrated. The injection molding configurations reduce the amount of plastic used in forming the hanger body (1) and the various elements described above. The configurations also allow the hanger body to cool evenly after being released from the mold to minimize warp. Naturally, various molding configurations can be used and the figures are not intended to limit the configurations to the two configurations shown.

Dual Point Hanger System. Now referring to FIG. 14, many objects to be hung such as pictures, mirrors, or the like, use a suspension element (21) such as a cord, wire, or similar material. The suspension element has a first end (22) and a second end (23) connected to the object to be hung. An object hanger comprising a hanger body (1) having a hanger body edge with a beveled surface (5) and at least one compression element (6) (which could be a continuous compression element, a discontinuous compression element, or a pair of discontinuous compression elements as discussed above) can be mounted to a hanging surface (24). Mounting can be accomplished with a mechanical fastener (30) responsive to mechanical fastener interpenetration element (4).

A dual point suspension location coordinator can be made responsive to suspension element (21). The dual point suspension location coordinator can comprise a first suspensory element (25), a second suspensory element (26), and a rotation axis approximately equidistant between the first suspensory element and the second suspensory element defined by the mechanical fastener interpenetration element (4) responsive to the mechanical fastener (30). The hanger body (1) can rotate pivotally about the rotation axis to adjust the location coordinates of the first suspensory element (25) and the second suspensory element (26). Importantly, the location coordinates of the first suspensory element (25) and the second suspensory element (26) are coupled. That is, the location coordinates of the first suspensory element (25) traverse an arc of approximately equal circumference and length but in opposite direction with respect to the location coordinates of the second suspensory element (26).

The suspension element (21) can be positioned between the beveled surface and the compression element (6). In some embodiments of the dual hanger system invention, the suspension element (21) can be guided down the inclined surface (7) of the compression element and positioned into a compression groove (8). The compression groove (8) enhances the application of frictional forces of the beveled (5) and inclined (7) surfaces to the surface of the suspension element (21). The enhanced application of frictional forces assists in holding the suspension element (21) in its desired location. The compression element (6) also locates the suspension element (21) away from the hanging surface (24) so that the entire weight of the object can be held by the dual point hanger system which assists in maintaining the desired orientation of the object relative to the hanging surface (24).

The dual point hanging system allows for substantial adjustment of the dual point suspension location coordinator to orient the object relative to the hanging surface (24). The dual point suspension location coordinator can be adjusted up to about 45 degrees off level with the horizon and the first suspensory element (25) and the second suspensory element (26) will still function as a first suspension point and a second suspension point for the suspension element (21). As can be understood, the dual point suspension location coordinator simultaneously locates the proper coordinates of the first suspensory element (25) and the second suspensory element (26) allowing fine adjustment of the orientation of the object with reduced effort. Even if the portion of the suspension element (21) that is made responsive to the hanger body (1) or the compression groove (8) (depending on the embodiment of the invention used) would not orient the object level in a single point hanger system, the dual point suspension location coordinator rotates under the weight of the object to a orientation that can be substantially level with the horizon.

Interlocking Hanger System. Now referring to FIG. 15, an embodiment of the invention provides a manner of interlocking a first hanger (27) and a second hanger (28). Regardless of the number of elements which make up the interlocking embodiment of the invention, the first hanger (27) and the second hanger (28) can have substantially identical configurations. As such, the first hanger (27) and the second hanger (28) can each comprise a hanger body (1) having a front surface (2) and a back surface (3), a hanger body edge having a beveled surface (5), a first mechanical fastener interpenetration element (4) or (9) which communicates between the front surface (2) and the back surface (3), a lateral adjustment projection (17), and a pair of lateral adjustment stops (18).

In some embodiments of the invention, the first hanger (27) and the second hanger (28) can further include a second mechanical fastener interpenetration element (10). In this embodiment of the interlocking invention, the first mechanical fastener interpenetration element (9) can define a rotation axis and the second mechanical interpenetration element can further comprise a rotation adjustment element (11) which allows the first hanger (27) and the second hanger (28) to be rotatably adjusted relative to the hanging surface or the object surface. The mechanical fastener interpenetration elements can also include mechanical fastener recess elements (19).

The first hanger (27) and the second hanger (28) may also include a compression element (6) and an inclined strike surface (12). As discussed above the compression element (6) can be continuous or as shown in FIG. 1 can comprise a pair of compression elements (6) set abutting the lateral adjustment stops (18). The angle of the inclined strike surface (12) can be configured to mate with the inclined surface (7) of compression element (6) when the first hanger (27) and the second hanger (27) are interlocked. The mating of these two inclined surfaces, as discussed above, provides a mated pair of friction surfaces in addition to the beveled surfaces (5). Not only does this manner of interlocking create additional friction surface area but also compresses the beveled surfaces (5) and the inclined surfaces (7) and (12) together to increase the friction between the surfaces. The increased friction surface area and the compression of the surfaces acts to resist movement of the first hanger (27) with respect to the second hanger (28). The interlocking embodiment of the invention can also include friction augmentation elements (20) on the back side (3) of the hanger body (1).

The first hanger body (27) and the second hanger body (28) can also include elements which interlock but which are not used in the interlocked embodiment of the invention. For example, the first hanger body (27) and the second hanger body (28) can include the mechanical fastener securement element (14), as described above.

Figure 15:
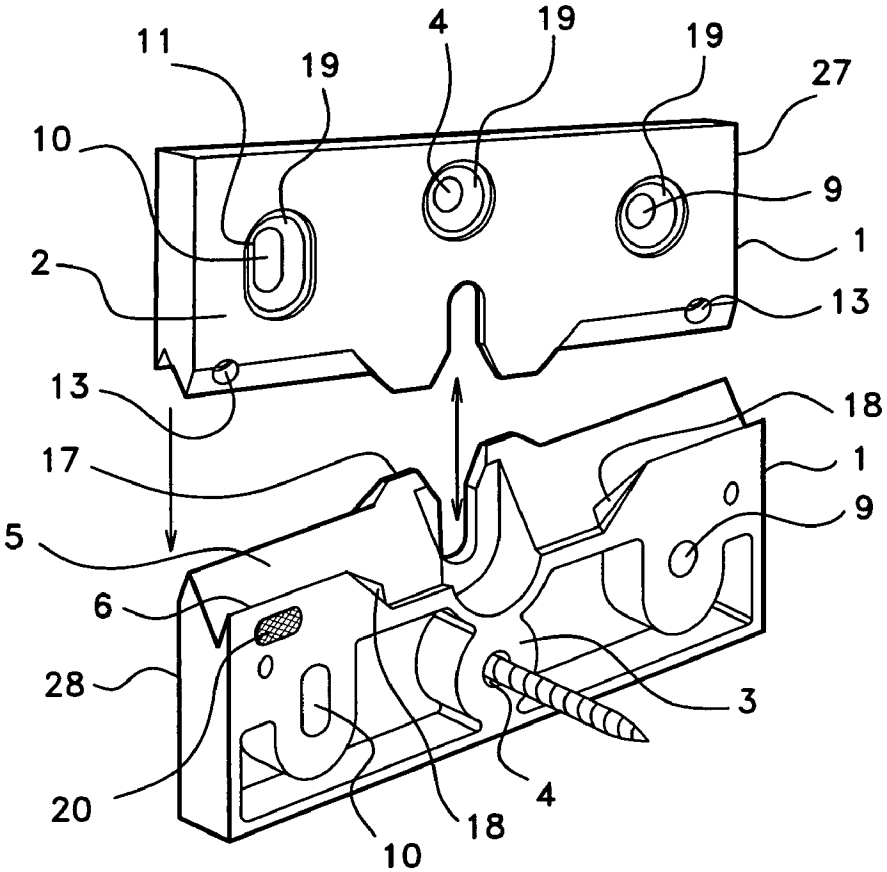
FIG. 15 shows a particular embodiment of the interlocking embodiment of the invention.

Three Point Hanger System. Now referring to FIGS. 15–17, an embodiment of a three point hanger system is shown. Generally, the three point hanger system comprises the use of a first hanger (27) and a second hanger (28) as shown in FIG. 15. The first hanger (27) comprises a hanger body (1) having a hanger body edge with a beveled surface (5). The first hanger (27) is mounted to the object surface so that the orientation of the first hanger remains fixed relative to the object surface. Fixing the orientation of the first hanger relative to the object surface can comprise the use of the strike surface mechanical interpenetration elements (13), or use of a first mechanical fastener interpenetration element (9) and the second mechanical fastener interpenetration element (10).

Figure 14:
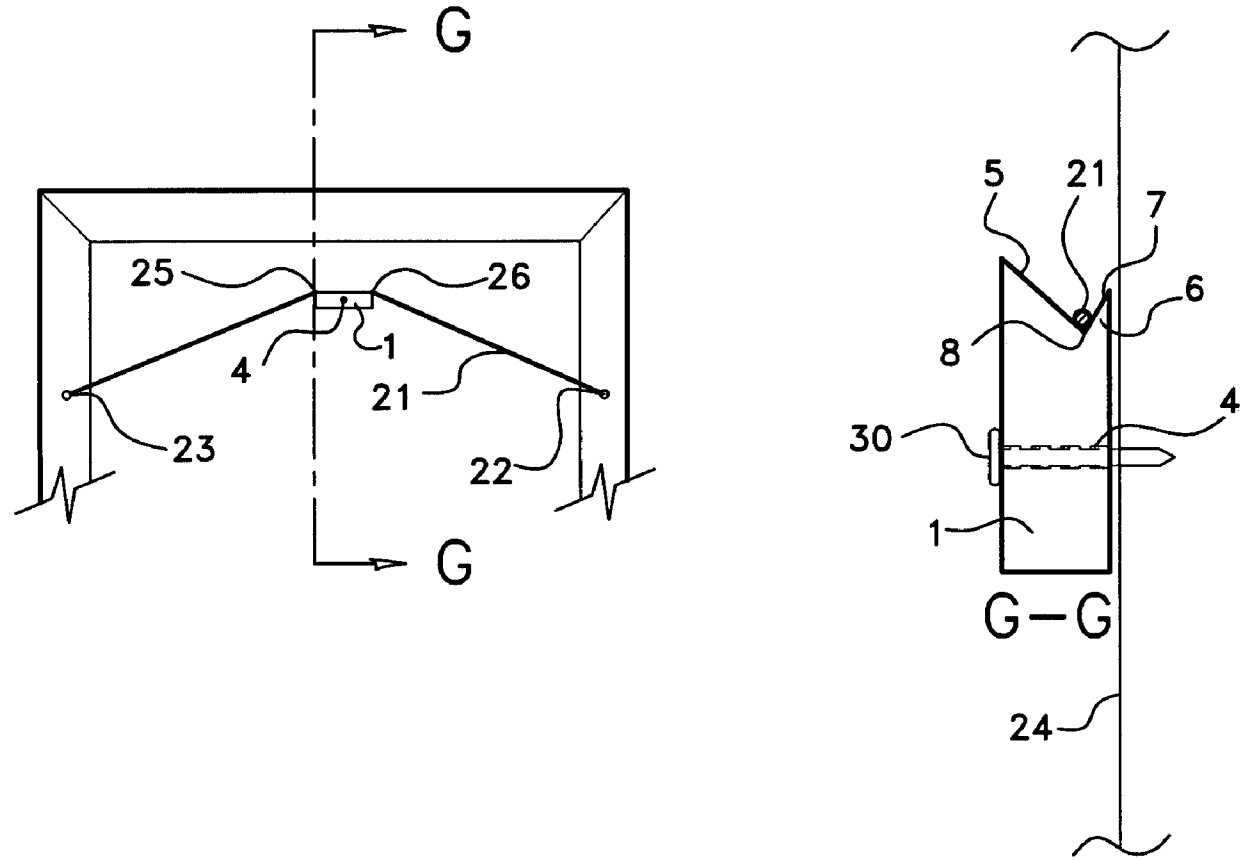
FIG. 14 shows a front view and a cross section of a particular embodiment of a dual point hanger system.

A substantially identical interlocking second hanger (28) comprising a hanger body (1) having an edge with a beveled surface (5) can be mounted to the hanging surface (24) so that the orientation of the second hanger body can be pivotally adjusted relative to said hanging surface (24) as shown in FIG. 14. Mounting the second hanger (28) can comprise use of the mechanical fastener interpenetration element (4). Mechanical fasteners responsive to the mechanical fastener interpenetration element (4) can be a screw, although other types of mechanical fasteners can be used as discussed above. The first hanger and the second hanger could also be mounted so that the first hanger is mounted to the hanging surface and the second hanger mounted to the object surface. Either approach can be effective. Once the first hanger (27) and the second hanger (28) are mounted to their respective surfaces, the hanger body edges having a beveled surface (5) can be interlocked.

The three point hanger system can further comprise a lateral adjustment projection. (14) which travels between the pair of lateral adjustment stops (18) when the first hanger and the second hanger are interlocked. The three point hanger system can further comprise at least one compression element (6) coupled to the beveled surface (5) of both the first hanger (27) the second hanger (28). In the three point hanging system, when the first hanger and the second hanger are interlocked the compression elements (6) serve to compress against the inclined strike surface (7) of the other interlocked hanger as previously discussed. The compression element (6) can be continuous in certain embodiments of the invention, or can be a pair of compression elements in embodiments of the invention which have the lateral adjustment projection (17) and lateral adjustment stops (18). Friction augmentation elements (20) can be further included in either the first or the second hanger. As shown in FIG. 15, the mechanical fastener interpenetration elements can further comprise fastener recess elements (19).

Figure 16:
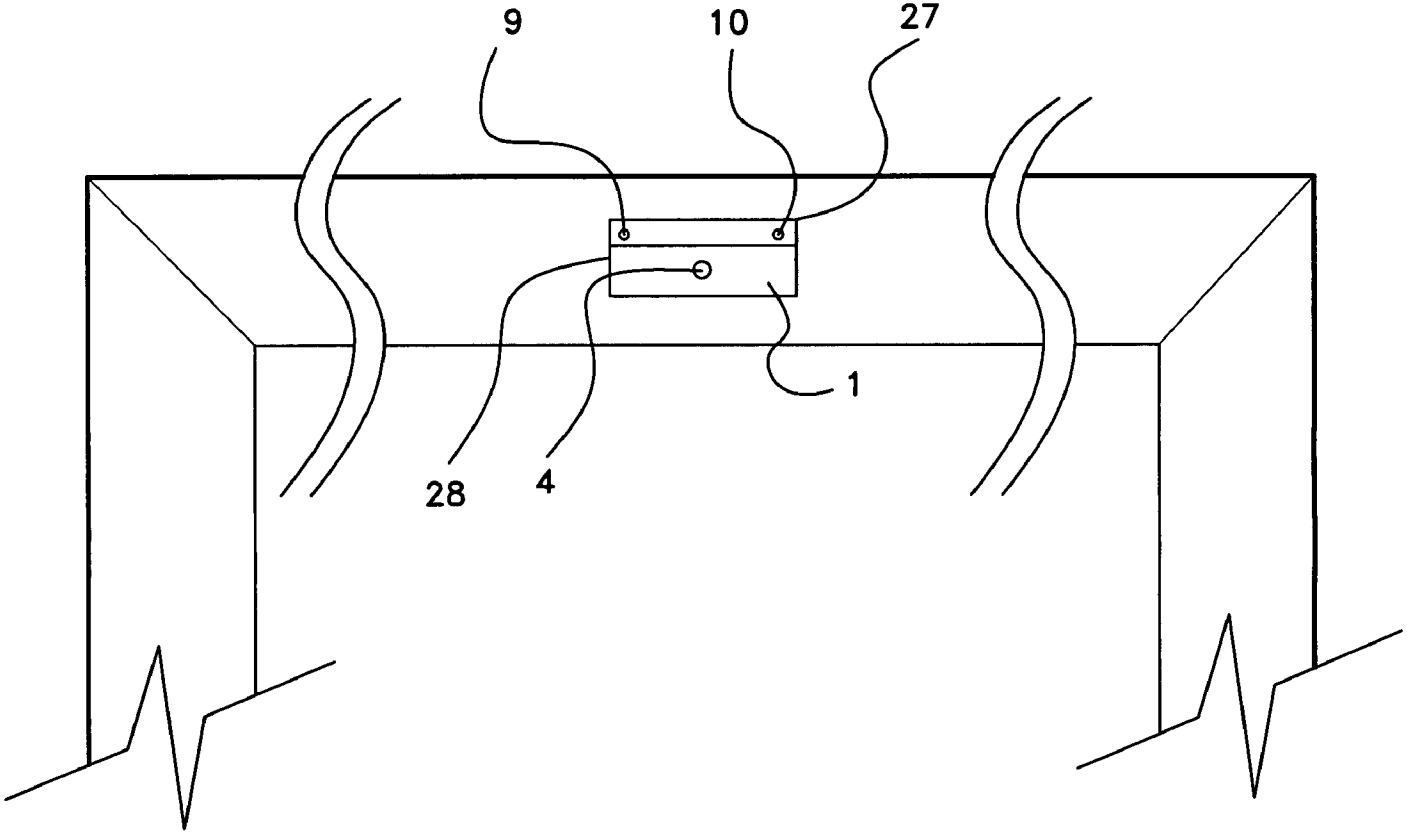
FIG. 16 shows a particular embodiment of a three point hanger system.
Figure 17:
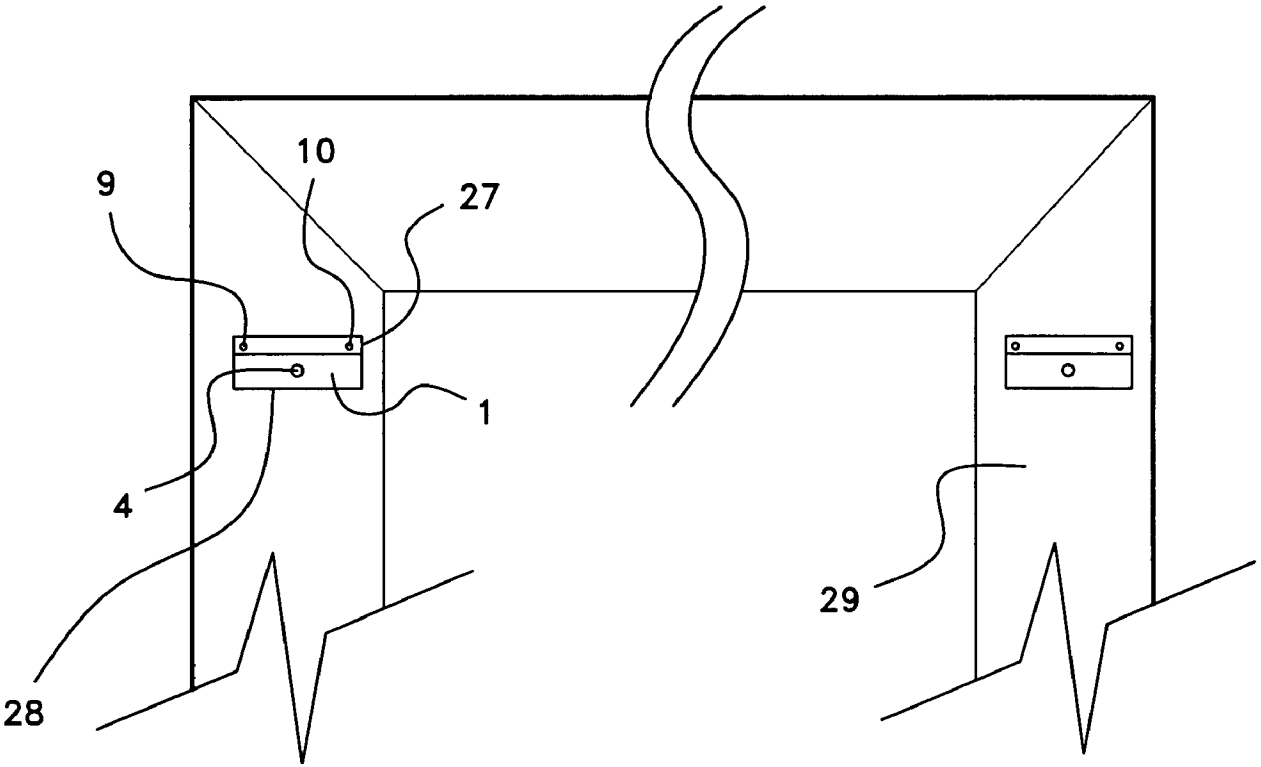
FIG. 17 shows a particular embodiment of a three point hanger system using two pair of interlocking hangers.

Now referring to FIGS. 16 and 17, the three point hanger system is illustrated with respect to hanging a conventional frame (naturally numerous types of objects could be hung with the three point hanger system). In FIG. 16, a first hanger (27) can be mounted to the top of the frame (29) and the second hanger (28) can be mounted to the hanging surface (24). In FIG. 17, two first hangers are mounted one on either side of a convention frame. Two second hangers (28) are mounted to the hanging surface. This approach may be used if desired, or may be necessary if an object is particularly large. A benefit of the three point hanger system with respect to large objects can be the elimination of wire-like suspension elements (21). When wire-like suspension elements (21) are used with larger objects, the objects tend to lean away from the wall. The three point hanger system invention using interlocking beveled surfaces (5) with compression elements (6) holds the object, framed item, picture, mirror, or the like snug to the hanging surface (24).

Figure 18:
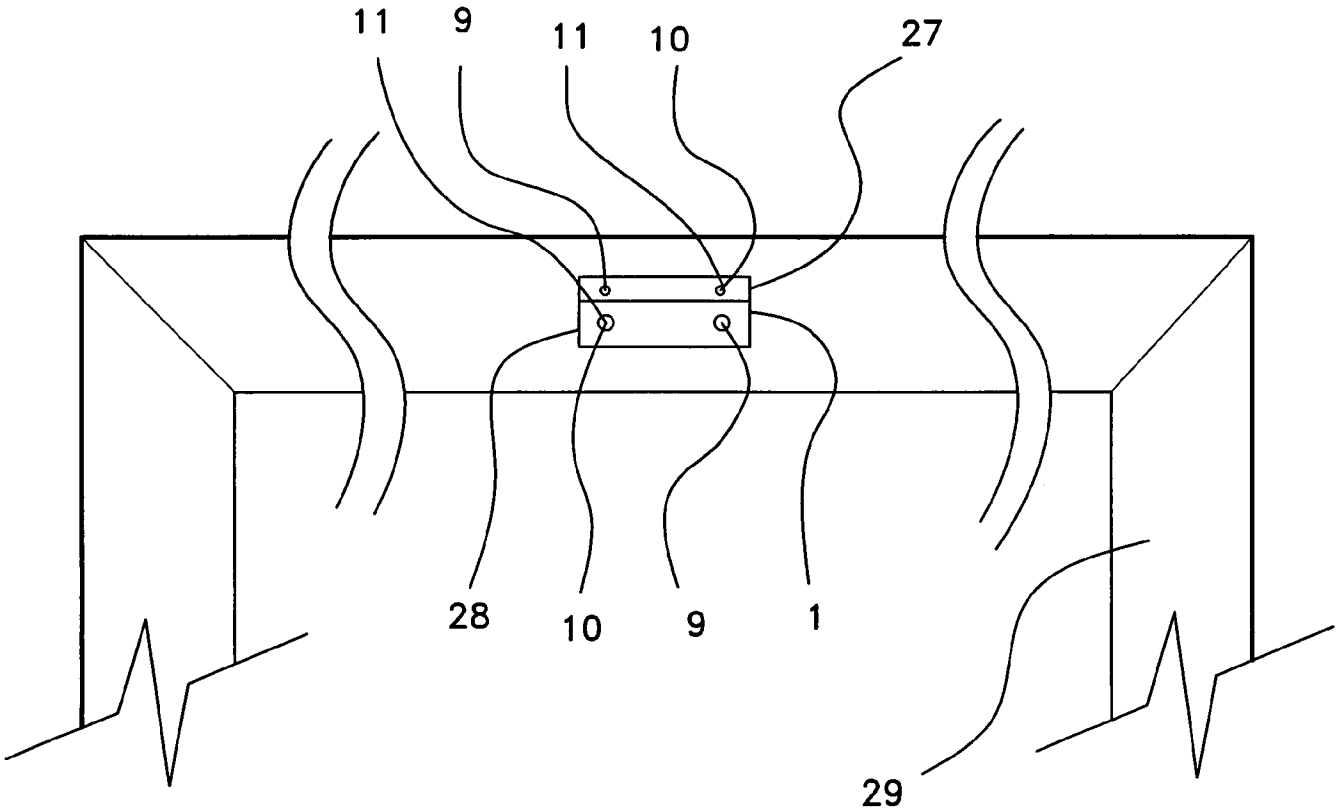
FIG. 18 shows a particular embodiment of a four point hanger system.

Four Point Hanger System. Now referring again to FIGS. 15 and 18, an embodiment of a four point hanger system invention is illustrated. Generally, the four point hanger system comprises a first hanger (27) that includes a first hanger body (1) having a front surface (2) and a back surface (3). A first mechanical interpenetration element (9) communicates between the front surface (2) and the back surface (3) and defines a rotation axis. A second mechanical interpenetration element (10) communicates between the front surface (2) and the back surface (3) of the hanger body (1) and can further provide a rotation adjustment element (11) coupled to the second mechanical interpenetration element (10).

At least one mechanical fastener can be responsive to each of the mechanical fastener interpenetration elements (9) (10) of the first hanger (27). The first hanger (27) can be mounted either to the object to be hung or to the hanging surface (24). The first hanger mounted to the object or the hanging surface (24) can be rotatably adjusted about the pivot axis defined by the first mechanical interpenetration element (9). The first hanger further includes a hanger body edge having a beveled surface (5).

The four point hanger system further comprises, a second hanger (28) that includes a second hanger body (1) having a front surface (2) and a back surface (3), a mechanical interpenetration element (9) between the front surface (2) and the back surface (3) that defines a rotation axis. A second mechanical interpenetration element (10) between the front surface (2) and the back surface (3) of the second hanger body (1) provides a rotation adjustment element (11) coupled to the second mechanical interpenetration element (10). At least one mechanical fastener can be responsive to each of the mechanical fastener interpenetration elements (9) (10) of the second hanger (28) so that the second hanger (27) can be mounted either to the object to be hung or to the hanging surface (24). The second hanger mounted to the object or the hanging surface (24) can be rotatably adjusted about the pivot axis defined by the first mechanical interpenetration element (9) similar to the first hanger. The second hanger further includes a hanger body edge having a beveled surface (5). The first hanger (27) and the second hanger (28) are interlocked to hang the object (29) to the hanging surface (24).

The four point hanger system invention can also include a lateral adjustment projection (17) coupled to the beveled surface (5) of the first hanger (27) which travels between a pair of lateral adjustment stops (18) coupled to the beveled surface (5) of the second hanger (28). The combination of the rotation adjustment element (11) and the lateral adjustment projection (17) allows the object to be rotationally and laterally adjusted with respect to the hanging surface. Because each hanger can be pivotally adjusted the rotational adjustment of the object relative to the hanging surface (24) can be substantial (exceeding 20 degrees with respect to some embodiments of the invention).

The object can resist movement from the desired orientation with respect to the hanging surface by coupling at least one compression element (6) to the beveled surface (5) of the first hanger (27) and at least one compression element (6) to the beveled surface (5) of the second hanger (28). As discussed, the compression element (6) can be continuous or comprise a pair of compression elements as shown in FIGS. 1 and 15. The compression element may further comprise an inclined surface (7) to mate with the inclined strike surface (12).

Any or all of the mechanical fastener interpenetration elements (9)(10) can have mechanical fastener recess elements (19). A friction augmentation surface may be coupled to the back side (3) of either the first hanger (27) or the second hanger (28).

Figure 19:
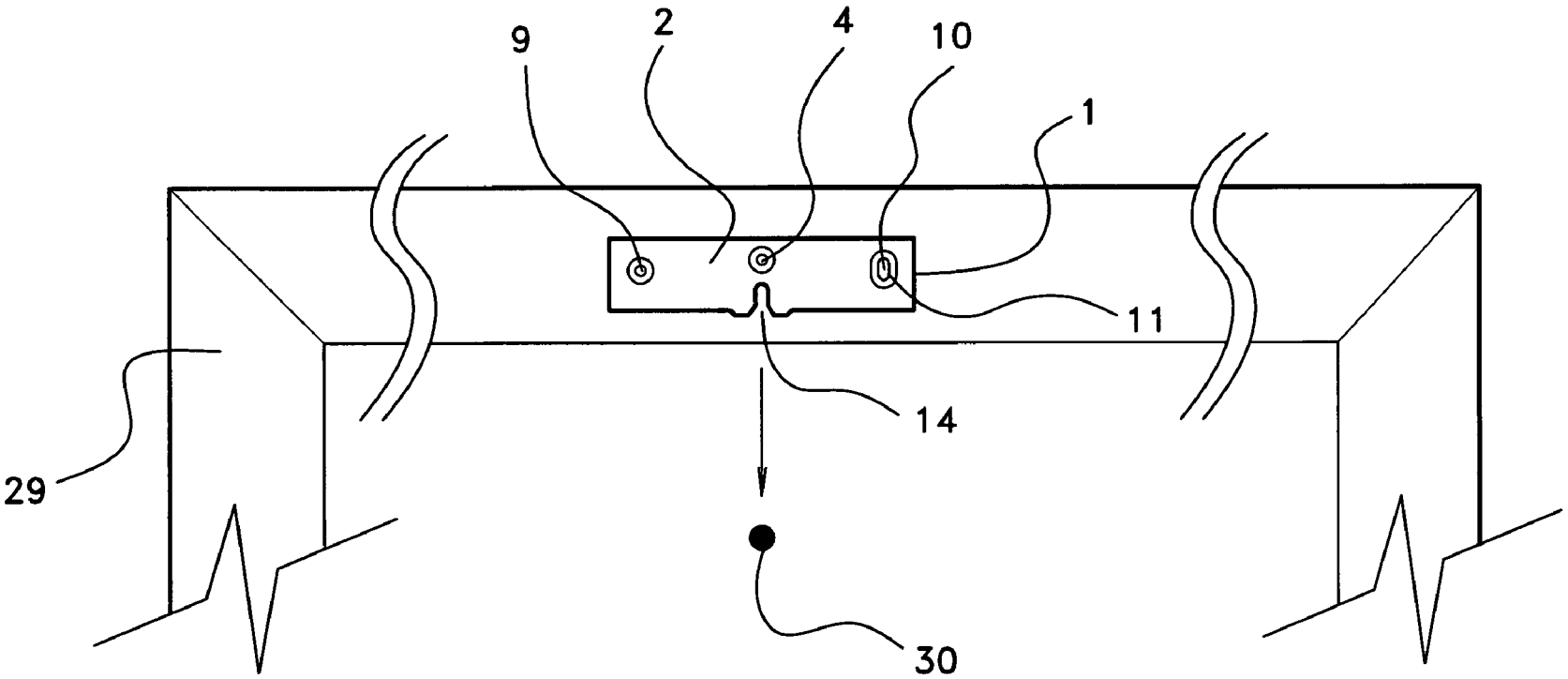
FIG. 19 shows a particular embodiment of a modified three point hanger system.
Figure 20:
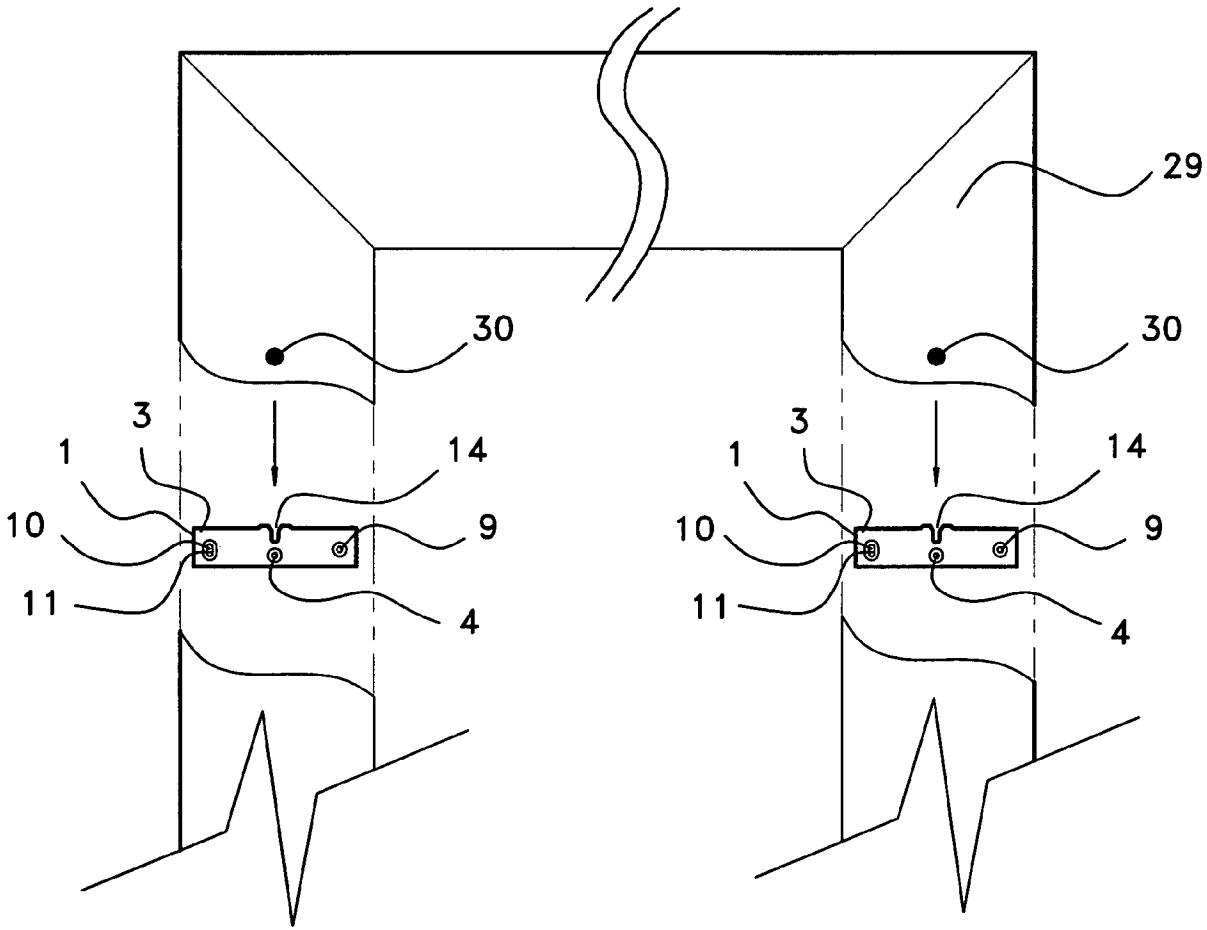
FIG. 20 shows a particular embodiment of a modified three point hanger system using two hangers.

Modified Three Point Hanger System. Now referring to FIGS. 19 and 20, a modified three point hanger system is illustrated. The basic embodiment of this invention comprises a single hanger body (1) having a front surface (2) and a back surface (3). A mechanical fastener securement element (14) is coupled to the hanger body edge. At least one mechanical fastener interpenetration element (4) can be used to mount the hanger body (1) to the object surface, such as the frame (20) shown in FIG. 19. Alternately mechanical fastener interpenetration elements (9)(10) can be used to mount the object if desired. A rotation adjustment element (11) can be coupled to either of the mechanical fastener interpenetration elements (9)(10) to allow for rotational adjustment of the object relative to the hanging surface. A mechanical fastener (30) having a head of larger diameter than the shaft or body can be set into the hanging surface. The body or shaft of the mechanical fastener can then be guided into the open perimeter of the interpenetration (15) and the head can then be located in recess (16). The diameter of the head of the mechanical fastener can selected so that it is too large to pull through the closed perimeter of interpenetration (15) and in that manner is held within recess (16). As shown by FIG. 20, the modified three point hanger system can be used with two hanger bodies to hang larger objects. Also as shown by FIG. 20, mechanical faster (30) can be set into the object to be hung and the hanger body (1) mounted to the hanging surface.

Figure 21:
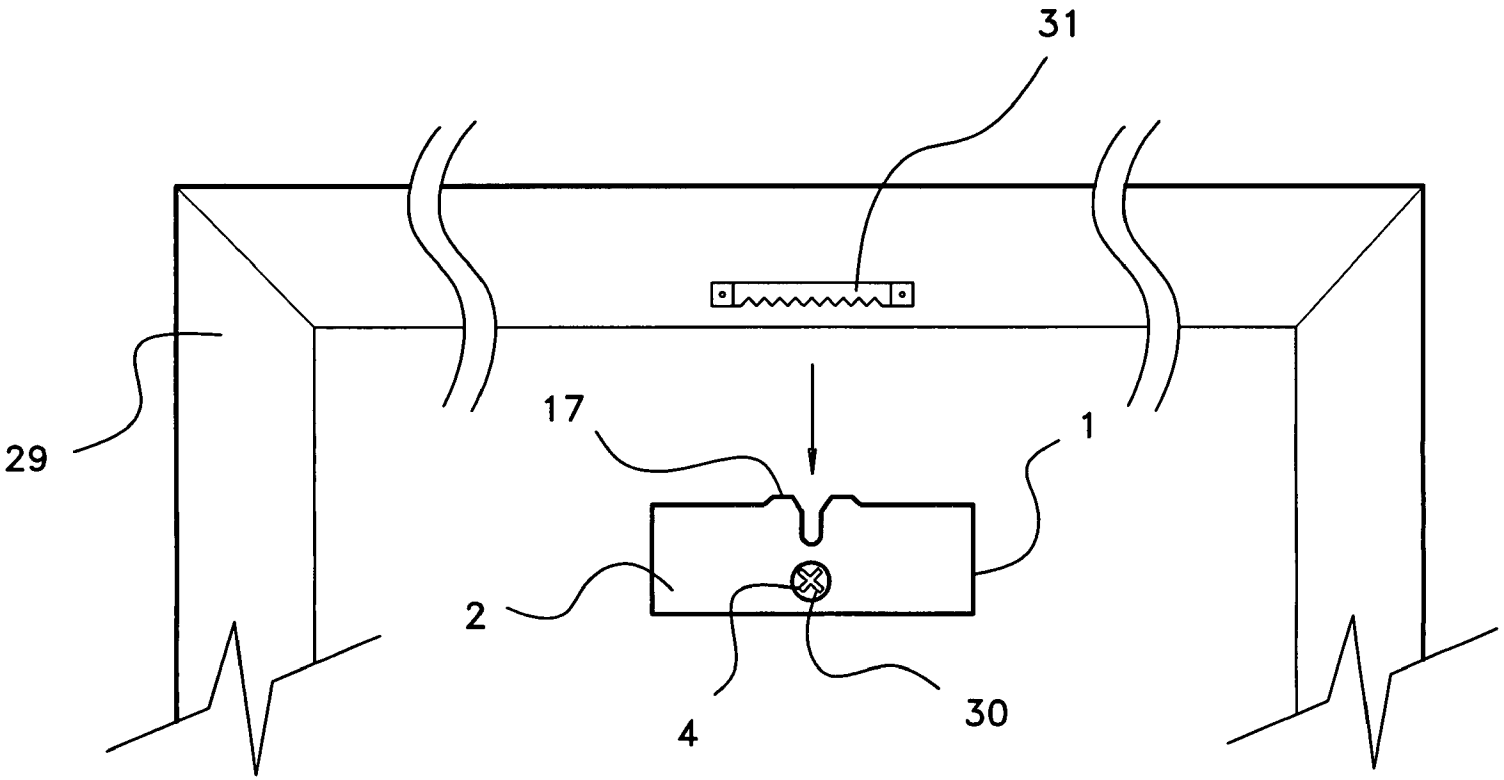
FIG. 21 shows a particular embodiment of a modified saw-tooth hanger system.
Figure 22:
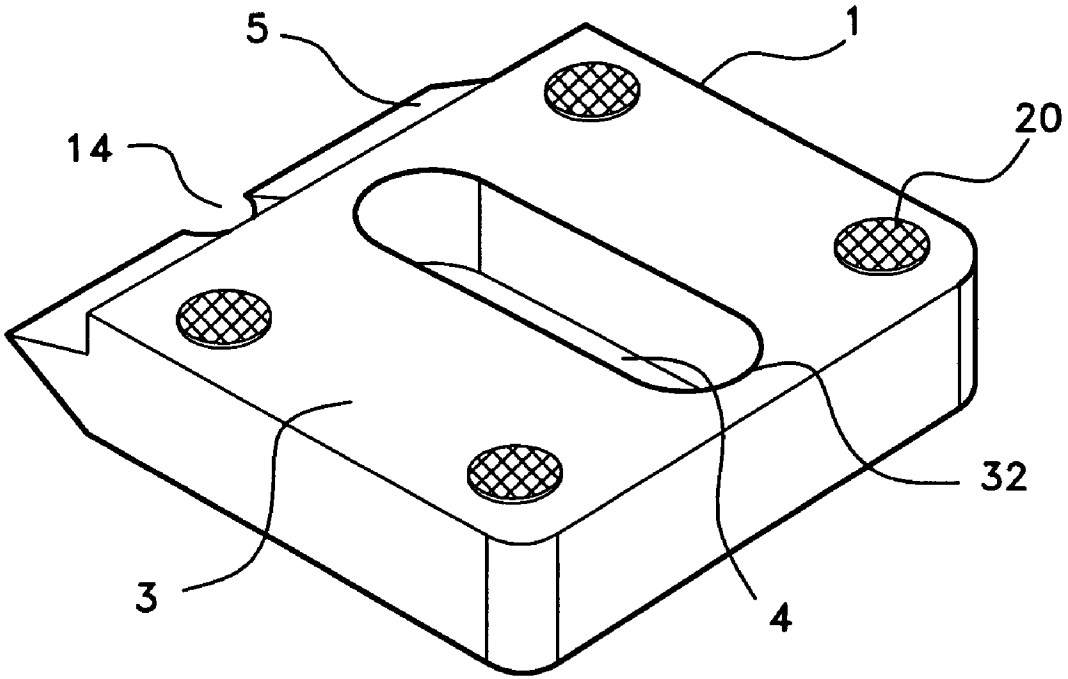
FIG. 22 shows a perspective of the backs side of particular embodiment of the invention having a vertical adjustment element.
Figure 23:
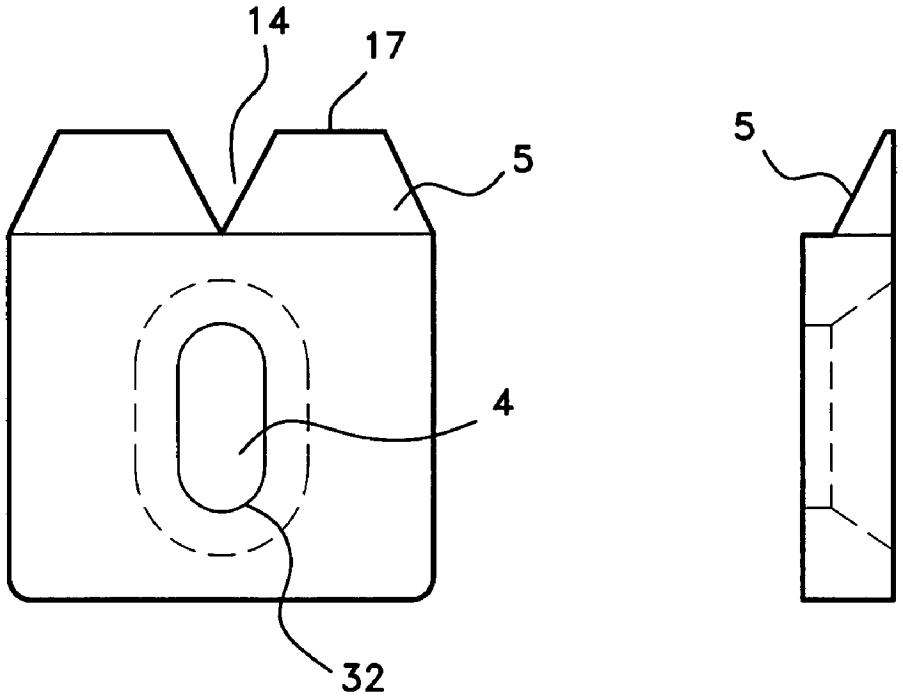
FIG. 23 shows a front view and a side view of a particular embodiment of the invention having a vertical adjustment element.

Modified Saw-tooth Hanger System. Now referring to FIGS. 21–23, a modified sawtooth hanger system is illustrated. Conventional saw tooth hangers are encompassed in the single point hanging system discussed above. Conventionally, a mechanical fastener, such as a nail or a screw is set in the hanging surface and the saw tooth (31) may be mounted to the object to be hung, such as a frame (29). The saw tooth is then conventionally positioned onto the mechanical fastener. The object then swings freely on the mechanical fastener. As such, a saw tooth hanger can have all the problems of a single point hanger system as discussed above. As shown by FIG. 21, the modified sawtooth hanger system can comprise a hanger body (1) having a hanger body edge with a beveled surface (5), at least one mechanical fastener interpenetration element (4), and a lateral adjustment projection (17). In the modified sawtooth hanger system, the sawtooth can be conventionally mounted to the object and the sawtooth hanger system invention can be mounted to the hanging surface with a mechanical fastener (30) that is responsive to the mechanical fastener interpenetration element (4). The sawtooth is then positioned onto the lateral adjustment element (17) and pulled down on the beveled surface (5) fixing the object relative to the hanger body (1). The hanger can then be adjusted about the rotation axis provided by mechanical fastener (30). FIGS. 22 and 23 show another embodiment of the modified sawtooth hanger system invention. This embodiment of the sawtooth hanger system invention further includes a vertical adjustment element (32) coupled to mechanical interpenetration element (4).

Figure 24:
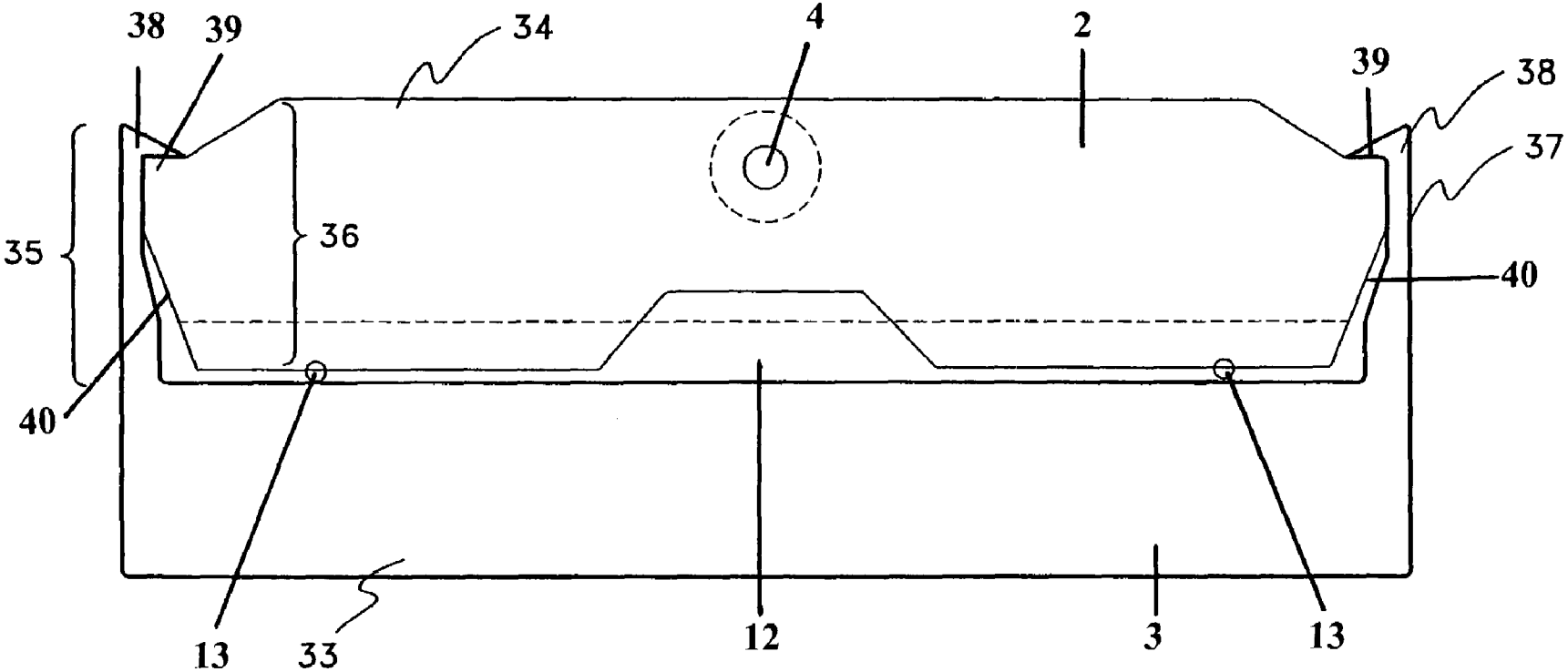
FIG. 24 shows a back view of a particular embodiment of the invention which can provide locked securement of objects to an hanging surface.
Figure 25:
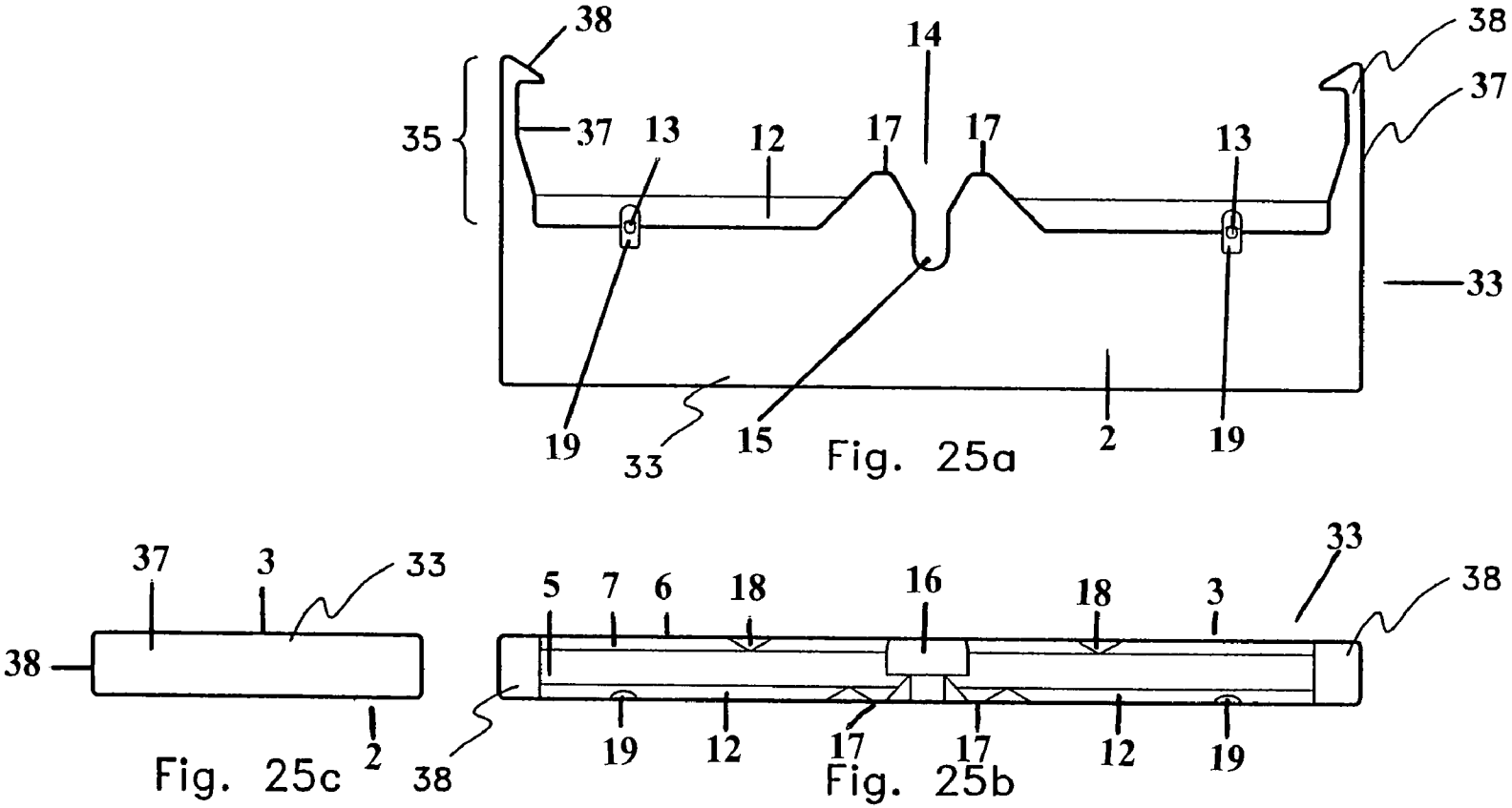
FIG. 25 shows a front view, top view, and end view of a particular embodiment of the invention having lock members comprising resiliently flexible projections each terminating in a catch element which can operate in opposed mated relation with the lock member engagement shown in FIG. 24 to provide locked securement of objects to a hanging surface.
Figure 26:
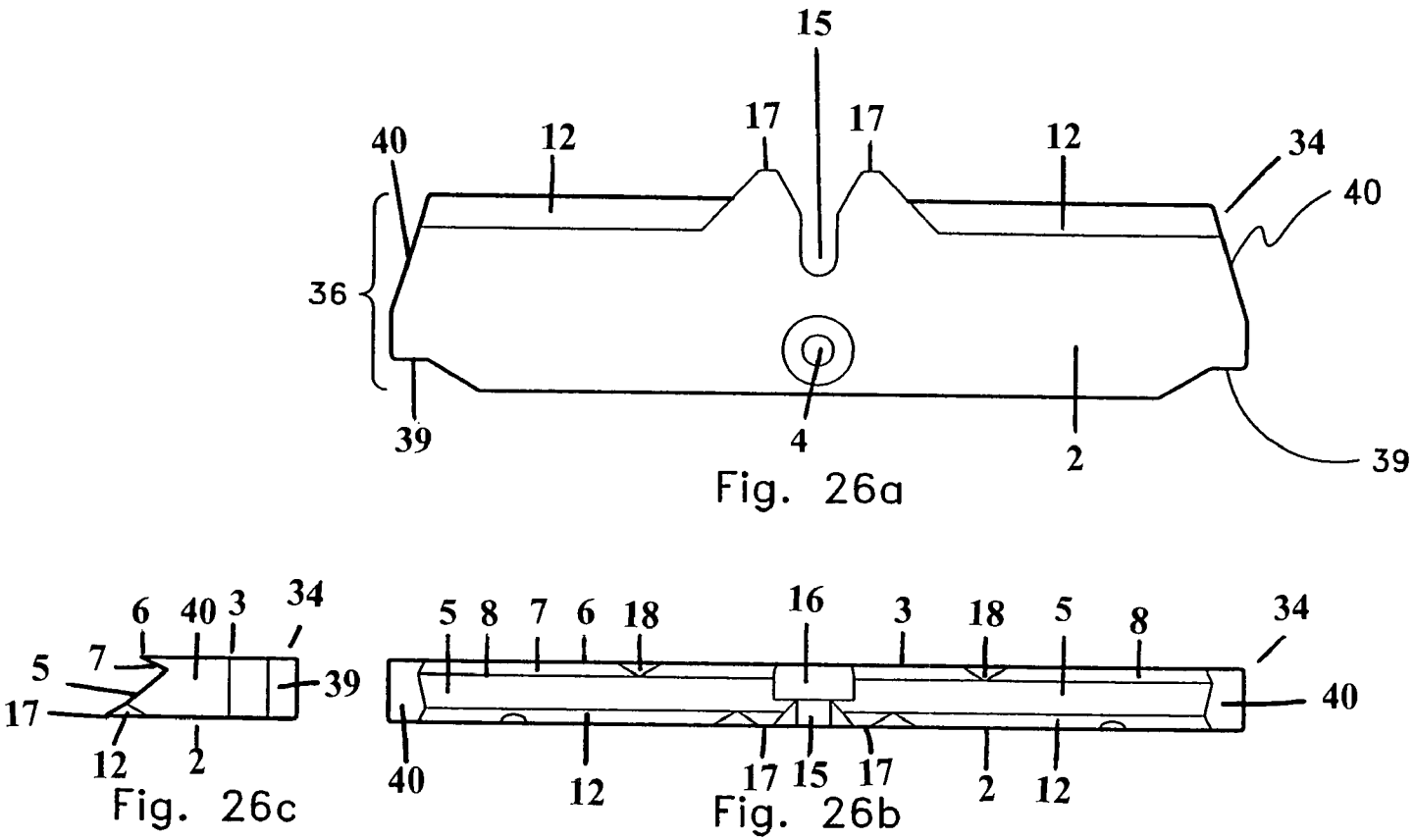
FIG. 26 shows a front view, top view, and end view of a particular embodiment of the invention providing lock member engagement with a catch element engagement surface and a lock member flexure element which can operate in opposed mated relation with the lock member shown in FIG. 25 to provide locked securement of objects to a hanging surface.

Now referring primarily to FIGS. 24 to 26, embodiments of the hanger invention can further provide lockable securement of objects to a hanging surface.

An embodiment of the lockable object hanger can include:

a. a first hanger body (33) having a front surface (2) and a back surface (3) which terminate in a first edge having a beveled surface (5);

b. at least one lock member (35) which extends from the first hanger body (33);

c. a second hanger body (34) having a front surface (2) and a back surface (3) which terminate in an edge having a beveled surface (5), wherein said beveled surface of the first hanger body (33) and the beveled surface of the second hanger body (34) are configured to engage in opposed mated relation; and d. at least one lock member engagement (36) coupled to the second hanger body (34), wherein the at least one lock member engagement (36) has a surface configured to engage the at least one lock member (35) to establish locked securement of the first hanger body (33) to the second hanger body (34) in opposed mated relation.

A first lockable hanger body (33) having at least one lock member (35) which can as to certain embodiments of the invention be continuously integral with the first lockable hanger body (33) and an lock member engagement (36) which can as to certain embodiments of the invention be continuously integral with the second lockable hanger body (34).

As shown in FIG. 24, the first lockable hanger body (33) and the second lockable hanger body (34), which can have substantially identical configuration other than the lock elements, can engage in opposed mated relation to allow locked securement of an object to a hanging surface.

As shown in FIG. 25, lock member(s)(35) can as to certain embodiments of the invention be configured as one or more resiliently flexible projection(s)(37) that extend a distance from the first lockable hanger body (33), from one end of the first lockable hanger body (33), or from both ends of the first lockable hanger body (33) as shown in FIG. 25. The air terminal of the resiliently flexible projection can provide a catch element (38) that can travel from a first location corresponding to the resting configuration of the resiliently flexible projection(s)(37) in an arc to a second location that can occur within the range of flexure of the resiliently flexible projection(s)(37). Upon release from the second location the catch element (38) can without assistance return substantially to the first location owing to the resiliency of the material from which the resiliently flexible projection (37) can be made.

Understandably the lock member (35) comprising the resiliently flexible projection (37) and catch element (38) could be made from a variety of materials (metal, plastic, wood, composite material, or combinations or permutations thereof) and in various configurations so long as a material can provide a configuration that allows sufficient flexure of the resiliently flexible projection (37) to allow travel of the catch element (38) from an engaged position to a release position, as described below.

Now referring primarily to FIG. 26, the second lockable hanger body (34) can have a configuration that provides at least one lock member engagement (36) with a catch element engagement surface (39). As shown in FIG. 24, a portion of the catch element (38) and the catch element engagement surface (39) can engage to some extent to provide locked securement of the first lockable hanger body (33) and the second lockable hanger body (34). The lock member engagement (36) can further provide a lock member flexure element (40) which can create flexure at a necessary, predetermined or desired rate or amount in the resiliently flexible projection (37) causing the catch element (38) to travel from the first location or resting configuration of the resiliently flexible projection(s)(37) to the second location as the first lockable hanger body (33) is operably mated with the second lockable hanger body (35). The lock member flexure element (40) can have a configuration that coordinates the release of the flexure in the resiliently flexible projection(s)(37) to allow the catch element (38) to engage the catch element engagement surface (39) when first lockable hanger body (33) operably engages the second lockable hanger body. Maintenance of locked securement can occur with significant flexure of the resiliently flexible projection (37) or without significant flexure in the resiliantly flexible projection (37) to avoid decay of flexure operation with time.

Disengaging the locked securement of the first lockable hanger body (33) with the second lockable hanger body (35) can be accomplished by applying force to the catch element(s) (38) to generate flexure in the resiliently flexible projection(s) (37) which allows sufficient travel in the catch element (38) to disengage the catch element (38) from the catch element engagement surface (39) providing disengagement of the second lockable hanger body (34) from the first lockable hanger body (35).

Figure 28:
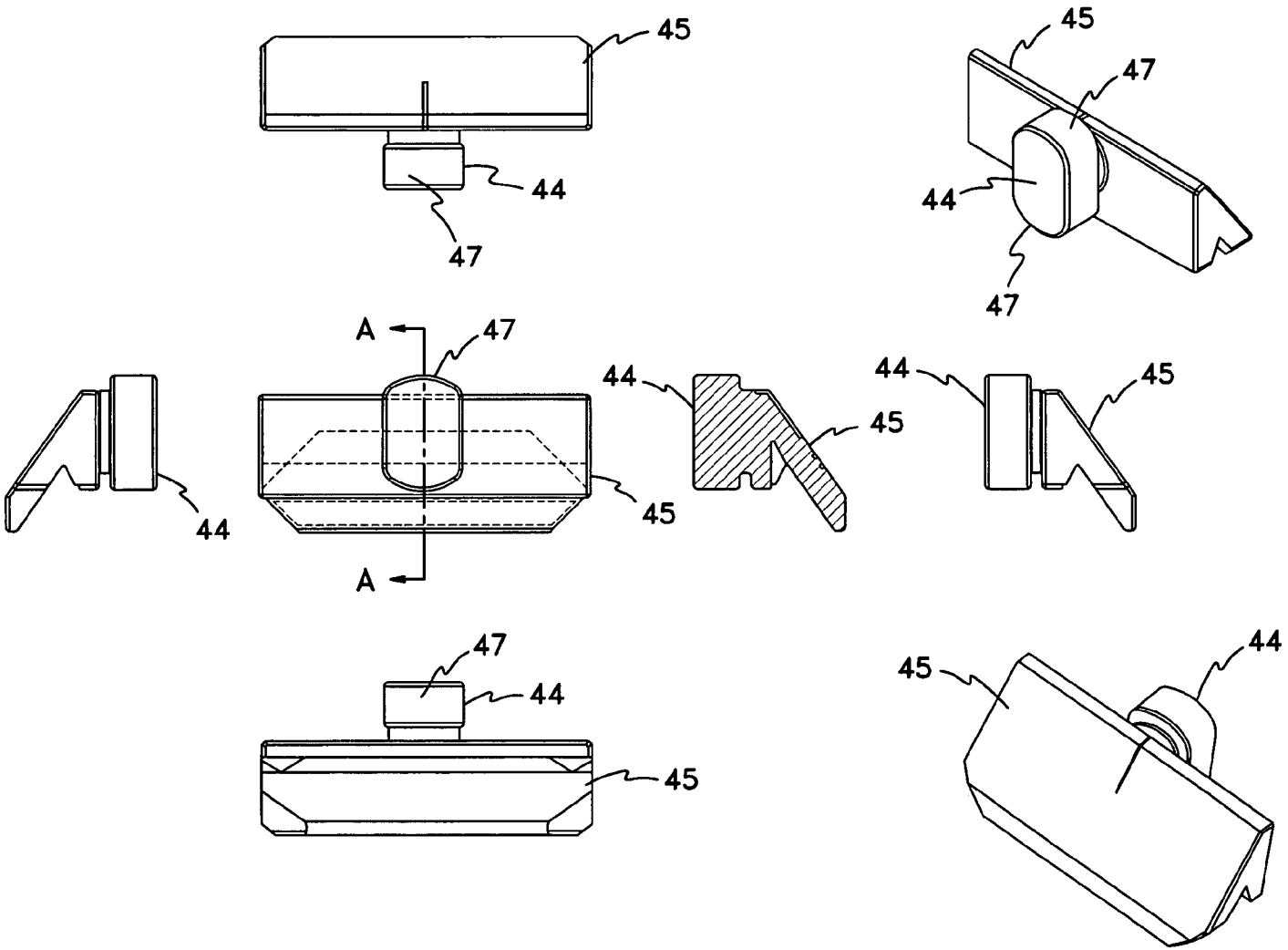
FIG. 28 shows additional views of a hanger having a radial resilient rotational lock.

Now referring primarily to FIGS. 27 and 28, a portion of an object frame (41) made from an extrusion is shown. Preferably, a frame used in conjunction with the embodiment of the invention shown could be extruded, from metal, plastic, wood, or composite materials so long as the material(s) afford a channel (42) having sufficiently resiliently flexible walls (43) to operate as described below.

The embodiment of the hanger invention shown further comprises a radially resilient rotational lock (44). The radially resilient rotational lock (44) has a configuration that may be longer than wide so that the width of the radially resilient rotational lock (44) can be inserted into the resiliently flexible channel (44) and rotated to engage the channel walls (43). Regardless of the exact shape chosen, by avoiding a perfectly circular configuration, the rotation of the radially resilient rotational lock (44) with respect to the resiliently flexible channel walls (43) can cause the opposed surfaces to radially compress to retain the radially resilient rotational lock (44) within the channel so that the radially resilient rotational lockable hanger body (45) attached to the radially resilient rotational lock (44) can be engaged in opposed mated relation to a second hanger body (46) to hang the framed object responsive to the extrusion (41). It is intended that the radially resilient rotational lock (44) could be used with or coupled to a wide variety of hangers including the various embodiments of the invention described herein, as well as, numerous types or kinds of conventional hangers. Specifically, the embodiments of the hanger invention shown in FIGS. 27 and 28, are not meant to limit the use of the radially resilient rotational lock (44) to these specific embodiments of the invention, but rather are meant to be illustrative with respect to the wide and numerous varieties of hangers that could be coupled to or otherwise employ the radially resilient rotational lock (44) invention.

Further, since it is possible that the radially resilient rotational lock (44) may be engaged for long periods of time, it may be desirable to have little or no radial compression when the radially resilient rotational lock (44) is fully engaged. Thus, the radial compression function of the radially resilient rotational lock (44) engaged with the walls (43) of the resiliently flexible channel (41) may not tend to decay with time in most applications. To adjust or reduce the level of radial compression when the radially resilient rotational lock is fully engaged, the radially resilient rotational lock configuration can further include an abutment element (47) which upon further rotation of the radially resilient rotational lock (44) in the channel (42) results in engagement of the abutment element (47) (which can be substantially planar) with the walls (43) of the resilient flexible channel (42) in the relaxed configuration of the extrusion (41). Various embodiments of the radially resilient rotational lock (44) invention can be configured to be used with numerous and various types of channel configurations and the invention is to be understood to include these numerous configurations. It is specifically not intended that the invention be limited to the configuration shown by the Figures, rather the Figures are to be considered illustrative of the numerous and wide variety of embodiments of the radially resilient rotational lock invention.

Once the abutment element (47) portion(s) of the radially resilient rotational lock (44) abut against or engage the walls (43) of the relaxed configuration of the extrusion (41) further rotation of the radially resilient rotational lock (44) then generates in resistance to rotation, or is locked in that position, until an amount of rotational force is applied to overcome the resistance of radial compression.

Since the radially resilient rotational lock (44) can be configured such that radial compression would not be reduced until the radially resilient rotational lock is fully assembled within the channel (41) of the selected or desired extrusion (41), the reduction in radial compression that can be felt during rotation can serve as one indication of full assembly thereby providing a level of assurance or fool proof assembly of the extrusion (41) with the radially resilient rotational lock (44) invention. Another advantage of this embodiment of the invention can be that radial compression forces are not necessary in order to retain the radially resilient rotational lock in the channel thereby preventing or minimizing any distortion of the extrusion itself.

As can be easily understood from the foregoing, the basic concepts of the present invention may be embodied in a variety of ways. It involves a hanger system which in some embodiments include lockable hanger bodies or in some embodiments a radially resilient rotational lock including both techniques as well as devices to accomplish hanging of objects on a hanging surface. In this application, various hanging techniques are disclosed as part of the result shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this nonprovisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in a full patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "hanger" should be understood to encompass disclosure of the act of "hanging"—whether explicitly discussed or not—and, conversely, were there effectively disclosure of the act of "hanging", such a disclosure should be understood to encompass disclosure of a "hanger" and even a "means for hanging". Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) each of the hanger devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented.

In this regard it should be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

I claim:

1. A lockable object hanger, comprising:

a. a first hanger body having a front surface and a back surface which terminate in a first hanger body edge having a beveled surface between a pair of lock members which extend from opposed ends of said first hanger body, wherein said pair of lock members comprises a pair of resiliently flexible projections each of which terminate in a catch element; and b. a second hanger body having a front surface and a back surface which terminate in a second hanger body edge having a beveled surface between a pair of lock member engagement elements coupled to opposed ends of said second hanger body, wherein each of said lock member engagement elements provides a catch element engagement surface, and wherein said beveled surface of said first hanger body edge and said beveled surface of said second hanger body edge engage in opposed mated relation, and wherein each of said pair of lock member engagement elements provides an external surface configured to generate outward flexure of a corresponding one each of said pair of resiliently flexible projections upon sliding engagement, and wherein each of said pair of pair of resiliently flexible projections travel inwardly to engage each said catch element with a corresponding one said catch element engagement surface to establish locked securement of said first hanger body to said second hanger body in opposed mated relation, and wherein each of said pair of resilient flexible projections maintains an amount of flexure during locked securement of said first hanger body with said second hanger body in opposed mated relation.

2. The object hanger as described in claim 1, further comprising:

a. a compression element which projects from said beveled surface of said first hanger body; and b. a compression element which projects from said beveled surface of said second hanger body.

3. The object hanger as descried in claim 2, wherein said compression element which projects from said beveled surface of said first hanger body and said compression element which projects form said beveled surface of said second hanger body each comprise a single continuous compression element which projects from each said beveled surface.

4. The object hanger as described in claim 2, wherein said compression element which projects from to said beveled surface of said first hanger body and said compression element which projects from said beveled surface of said second hanger body each comprise a pair of compression elements which project from each said beveled surface.

5. The object hanger as described in claim 3 or 4, wherein each said compression element which projects from said beveled surface further comprises an inclined surface which intersects each said beveled surface.

6. The object hanger as described in claim 4, further comprising:

a. a lateral adjustment projection coupled to said beveled surface of said first hanger body; and b. a pair of lateral adjustment stops coupled to said beveled surface of said second hanger body, whereby said lateral adjustment element travels between said pair of lateral adjustment stops.

7. A lockable object hanger as described in claim 1, further comprising an interpenetration element between said front surface and said back surface of said second hanger body which provides a rotation axis about which said second hanger body rotates.

8. A lockable object hanger as described in claim 7, further comprising at least one interpenetration element between said front surface and said back surface of said first hanger body.

* * * * *